US008408531B2

(12) United States Patent
Sato

(10) Patent No.: US 8,408,531 B2
(45) Date of Patent: Apr. 2, 2013

(54) RECORDING MEDIUM POST-PROCESSING APPARATUS AND IMAGE FORMING SYSTEM

(75) Inventor: Ryuichi Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/030,889

(22) Filed: Feb. 18, 2011

(65) Prior Publication Data

US 2012/0045295 A1 Feb. 23, 2012

(30) Foreign Application Priority Data

Aug. 23, 2010 (JP) ..... 2010-186021

(51) Int. Cl.
*B65H 37/04* (2006.01)

(52) U.S. Cl. ..... 270/58.12; 270/58.07; 270/58.11; 270/58.17; 270/58.27

(58) Field of Classification Search ..... 270/58.07, 270/58.08, 58.11, 58.12, 58.17, 58.27; 399/407, 399/408

See application file for complete search history.

(56) References Cited

U.S. PATENT DOCUMENTS

| | | | | |
|---|---|---|---|---|
| 5,580,039 | A * | 12/1996 | Takehara et al. | 270/58.11 |
| 6,641,129 | B2 * | 11/2003 | Ogita et al. | 270/58.08 |
| 7,284,752 | B2 * | 10/2007 | Nagata et al. | 270/58.18 |
| 7,992,857 | B2 * | 8/2011 | Igata | 270/58.11 |
| 2007/0096381 | A1 * | 5/2007 | Nishioka | 270/58.12 |
| 2009/0065999 | A1 * | 3/2009 | Iguchi et al. | 270/58.08 |

FOREIGN PATENT DOCUMENTS

| | | |
|---|---|---|
| JP | 2004-277036 A | 10/2004 |
| JP | 2008-110468 A | 5/2008 |

* cited by examiner

*Primary Examiner* — Leslie A Nicholson, III
(74) *Attorney, Agent, or Firm* — Sughrue Mion, PLLC

(57) ABSTRACT

A recording medium post-processing apparatus includes: a recording medium stacking unit on which recording media are stacked; a binding section that binds the recording media by deforming the recording media in a thickness direction, and retracts to the outside of the stacking area of the recording media after binding the recording media; a reference member that functions as a position reference used for aligning the recording media; and an alignment unit that aligns end portions of the recording media facing the reference member by moving the recording media to a position where the recording media come into contact with the reference member from a position where the recording media are separated from the reference member.

11 Claims, 20 Drawing Sheets

RECORDING MEDIUM POST-PROCESSING APPARATUS AND IMAGE FORMING SYSTEM

CROSS-REFERENCE TO RELATED APPLICATION

This application is based on and claims priority under 35 U.S.C. 119 from Japanese Patent Application No. 2010-186021 filed on Aug. 23, 2010.

BACKGROUND

1. Technical Field

The present invention relates to a recording medium post-processing apparatus and an image forming system.

2. Related Art

There are image forming apparatuses, such as printers or copying machines, to which recording medium post-processing apparatuses for performing post-processing on recording media on which images have been formed are connected.

SUMMARY

According to an aspect of the invention, there is provided a recording medium post-processing apparatus including:

a recording medium stacking unit on which recording media are stacked;

a binding section that is moved to the inside of a stacking area of the recording media stacked on the recording medium stacking unit, binds the recording media by deforming the recording media in a thickness direction, and retracts to the outside of the stacking area of the recording media after binding the recording media;

a reference member that is moved to the inside of the stacking area while maintaining separation from the recording media stacked on the recording medium stacking unit as the binding section is moved to the inside of the stacking area, and functions as a position reference used for aligning the recording media; and an alignment unit that aligns end portions of the recording media facing the reference member by moving the recording media to a position where the recording media come into contact with the reference member from a position where the recording media are separated from the reference member, before the binding section binds the recording media.

BRIEF DESCRIPTION OF THE DRAWINGS

Exemplary embodiments of the present invention will be described in detail based on the following figures, wherein:

FIGS. 5A and 5B are perspective views of the first binding unit and the like;

FIGS. 6A and 6B are perspective views of the first binding unit and the like;

FIG. 7 is a perspective view of the first binding unit and the like;

FIG. 13 is a perspective view of the first binding unit and the like;

DETAILED DESCRIPTION

An exemplary embodiment of the invention will be described in detail below with reference to the accompanying drawings.

<Description of Image Forming System>

Figure 1:
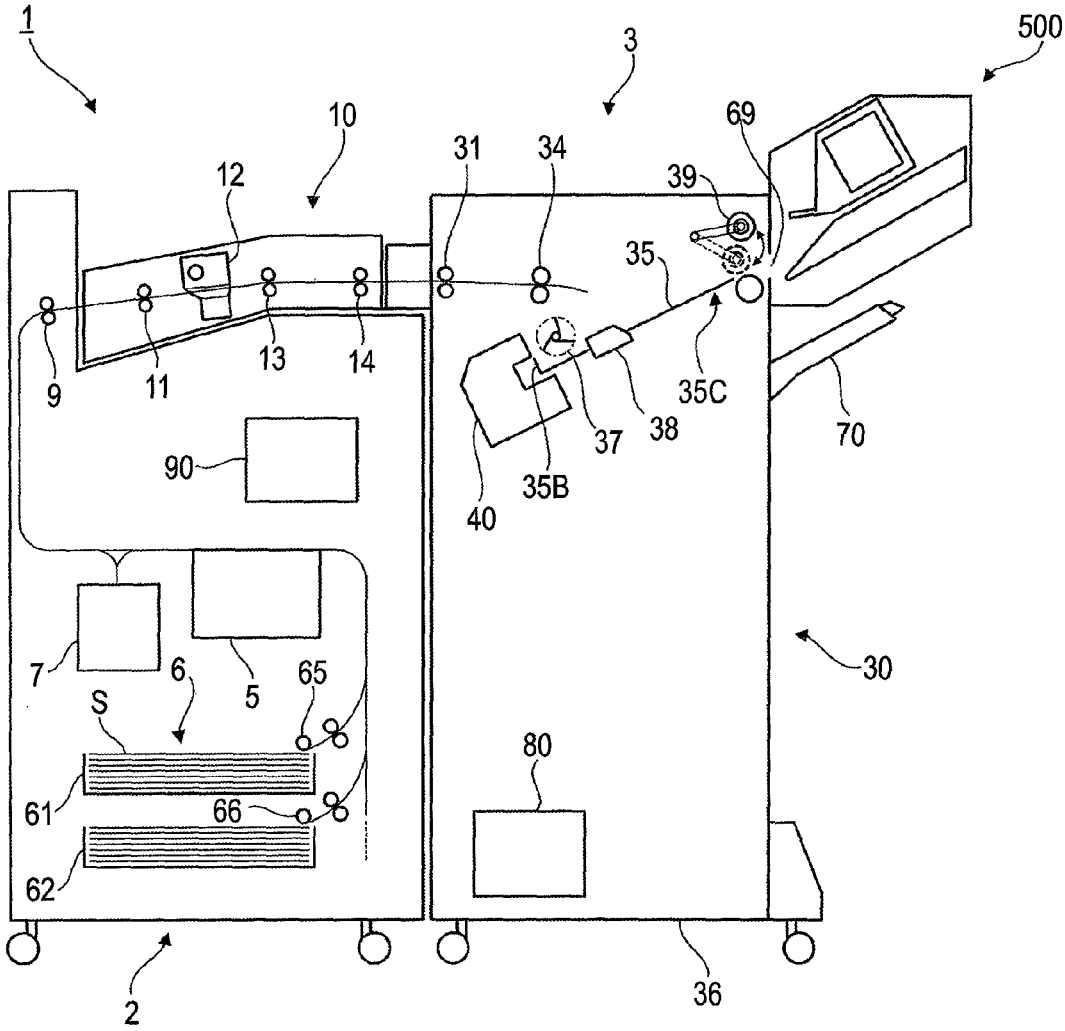
FIG. 1 is a schematic view showing the configuration of an image forming system to which this exemplary embodiment is applied.

FIG. 1 is a schematic view showing the configuration of an image forming system 1 to which this exemplary embodiment is applied. The image forming system 1 includes an image forming apparatus 2 and a sheet processing apparatus 3. The image forming apparatus 2 serves as an example of an image forming apparatus, such as a copying machine or a printer, which forms an image by, for example, an electrophotographic method. The sheet processing apparatus 3 serves as an example of a recording medium post-processing apparatus that performs predetermined post-processing on sheets (recording media) S on which, for example, toner images have been formed by the image forming apparatus 2.

<Description of Image Forming Apparatus>

The image forming apparatus 2 includes a sheet feed section 6 and an image forming section 5. The sheet feed section 6 feeds a sheet S. The image forming section 5 forms an image on the sheet S, which is fed from the sheet feed section 6, by an electrophotographic method. Meanwhile, a structure for forming an image by an ink-jet method or the like may be used as the image forming section 5. Further, the image forming apparatus 2 includes a sheet reversing device 7 and carrying rollers 9. The sheet reversing device 7 reverses the surface of the sheet S on which an image has been formed by the image forming section 5. The carrying rollers 9 take out the sheet S on which an image has been formed. Furthermore, the image forming apparatus 2 includes a user interface 90 that receives information from a user. Here, the sheet feed section 6 includes first and second sheet stacking units 61 and 62 on which sheets S are stacked. Moreover, the sheet feed section 6 includes conveying rollers 65 and 66. The conveying roller 65 conveys the sheets S, which are stacked on the first sheet stacking unit 61, toward the image forming section 5. The conveying roller 66 conveys the sheets S, which are stacked on the second sheet stacking unit 62, toward the image forming section 5.

<Description of Sheet Processing Apparatus>

The sheet processing apparatus 3 includes a conveying device 10 and a main body section 30. The conveying device 10 conveys the sheets S that are taken out from the image forming apparatus 2. The main body section 30 is provided with a sheet stacking unit 35 where the sheets S conveyed by the conveying device 10 are stacked, a stapler 40 that binds the end portions of the sheets S, and the like. Further, the sheet processing apparatus 3 includes a control section 80 that controls the entire image forming system 1. The control section 80 includes a CPU (Central Processing Unit), a ROM (Read Only Memory), a RAM (Random Access Memory), and an HDD (Hard Disk Drive) (which are not shown). A processing program for controlling the image forming system 1 is executed in the CPU. Various programs, various tables, parameters, and the like are stored in the ROM. The RAM is used as a work area and the like when the processing program is executed by the CPU.

The conveying device 10 of the sheet processing apparatus 3 includes inlet rollers 11 and a puncher 12. The inlet rollers 11 are a pair of rollers that receives the sheet S taken out by the carrying rollers 9 of the image forming apparatus 2. The puncher 12 bores a hole through the sheet S that is received by the inlet roller 11 as necessary. Further, the conveying device 10 includes first and second conveying rollers 13 and 14 that are disposed on the downstream side of the puncher 12. The first conveying rollers 13 are a pair of rollers that conveys a sheet S to the downstream side. The second conveying rollers 14 are a pair of rollers that conveys a sheet S toward the main body section 30.

The main body section 30 of the sheet processing apparatus 3 is provided with a main body frame 36 that is formed in the shape of a box. Moreover, the main body section 30 is provided with receiving rollers 31 that is a pair of rollers for receiving a sheet S from the conveying device 10. Further, the main body section 30 is provided with the sheet stacking unit 35 and exit rollers 34. The sheet stacking unit 35 is disposed on the downstream side of the receiving roller 31, and sheets S are stacked on the sheet stacking unit 35. The exit rollers 34 are a pair of rollers for taking out a sheet S toward the sheet stacking unit 35. Furthermore, the main body section 30 is provided with a paddle 37. The paddle 37 is rotated in a clockwise direction in FIG. 1 so as to convey the sheet S, which is conveyed by the exit rollers 34, toward an end guide 35B of the sheet stacking unit 35. In addition, the main body section 30 is provided with tampers 38. The tampers 38 are provided so as to face one side portion and the other side portion of a sheet S, respectively, and align the sheet S by pushing the sheet S so that the sheet S is interposed between the tampers.

Moreover, the main body section 30 is provided with an ejection roller 39 that can be moved in a direction where the ejection roller approaches the sheet stacking unit 35 and in a direction where the ejection roller is separated from the sheet stacking unit 35. When a sheet S is stacked on the sheet stacking unit 35, the ejection roller 39 retracts to a position separated from the sheet stacking unit 35 (a position above the sheet stacking unit 35 in a vertical direction). Further, when a bundle of sheets S (hereinafter, referred to as a "sheet bundle T") is taken out from the sheet stacking unit 35, the ejection roller 39 is moved until coming into contact with a sheet bundle T. Then, the ejection roller 39 conveys the sheet bundle T to the downstream side while being rotated.

Furthermore, the main body section 30 includes a stapler 40. The stapler 40 binds the end portion of the sheet bundle T, which is stacked on the sheet stacking unit 35, (the rear end portion of the sheet bundle T in the conveying direction of the sheet bundle T) by staples.

Moreover, the main body section 30 includes an opening 69 at the side wall of the main body frame 36. The opening 69 is used to take out a sheet bundle T that is conveyed by the ejection roller 39.

In addition, the main body section 30 is provided with a binding device 500. The binding device 500 performs binding processing on the front end portion of the sheet bundle T that is conveyed by the ejection roller 39 (the front end portion of the sheet bundle T in the conveying direction of the sheet bundle T). Unlike the stapler 40 that performs binding processing by using staples, the binding device 500 performs binding processing with a method of combining sheets S by deforming the sheet bundle T in a thickness direction without using staples. Meanwhile, the binding device 500 is formed separately from the main body frame 36, and is set to be removed from the main body frame 36.

Further, the main body section 30 is provided with a sheet bundle stacking unit 70 where the sheet bundle T bound by the stapler 40 and the sheet bundle T bound by the binding device 500 are stacked. The sheet bundle stacking unit 70 is adapted to be moved down according to the amount of the stacked sheet bundle T. Furthermore, when the binding processing performed by the stapler 40 is switched to the binding processing performed by the binding device 500 and when the binding processing performed by the binding device 500 is switched to the binding processing performed by the stapler 40, the control section 80 performs a control to switch the output direction of image data so that a portion of the sheet bundle bound in each binding processing becomes an upper or left portion of an image.

<Description of Binding Device>

Next, the binding device 500, which performs binding processing by deforming the sheet bundle T in the thickness direction, will be described in detail.

Figure 2:
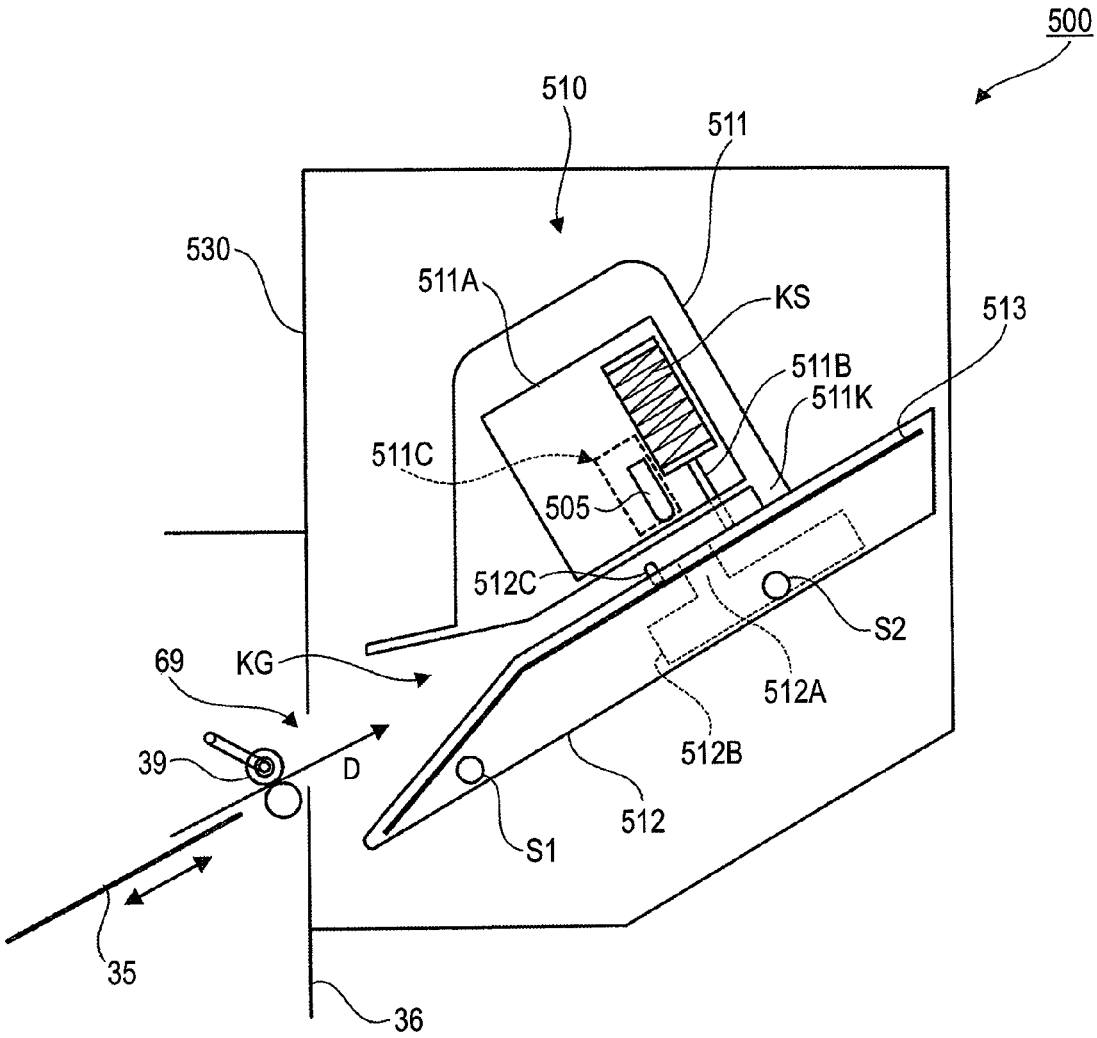
FIG. 2 is a view illustrating a binding device.
Figure 3:
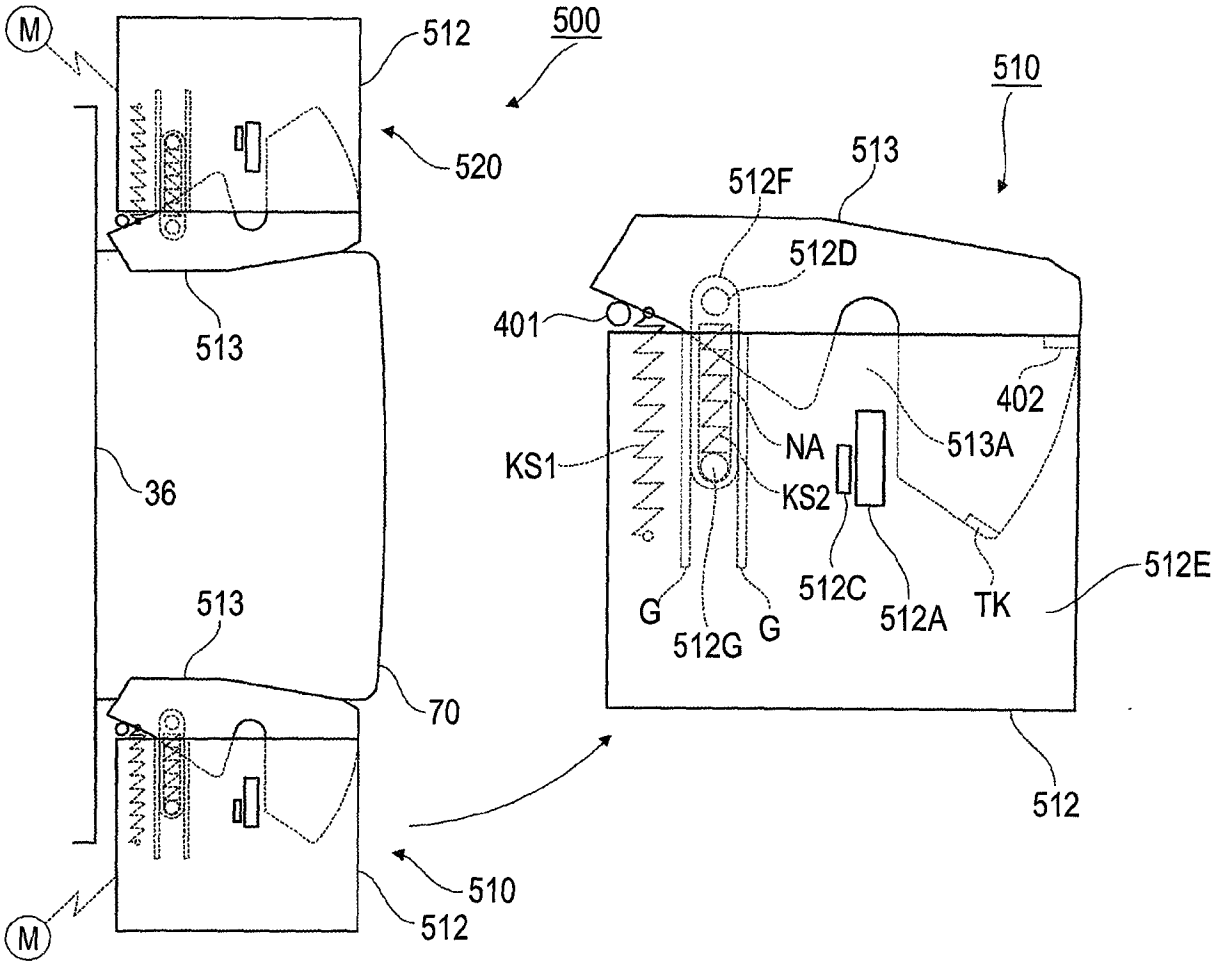
FIG. 3 is a view illustrating the binding device.

FIGS. 2 and 3 are views illustrating the binding device 500. Here, FIG. 2 is a view showing the binding device 500 as seen from the front side (front) of the image forming system 1, and FIG. 3 is a view showing the binding device 500 as seen from the upper side of the image forming system 1. However, a device frame 530 (to be described below) and an upper frame 511 (to be described below) are not shown in FIG. 3.

As shown in FIG. 2, the binding device 500 includes a device frame 530 that is formed in the shape of a box and disposed in a direction orthogonal to the conveying direction of the sheet bundle T (a depth direction of the image forming system 1). Meanwhile, although not shown, an opening is formed at a middle portion of the device frame 530 in a longitudinal direction of the device frame 530 and at a lower portion of the device frame 530 in order to make the sheet bundle T, which is placed on a rotating plate 513 (to be described below), fall into the sheet bundle stacking unit 70 as necessary.

Further, the binding device 500 is provided with first and second binding units 510 and 520. FIG. 2 is a view showing the first binding unit 510 that is provided on the front side. As shown in FIG. 2, the first binding unit 510 is supported by the device frame 530, and is adapted to be moved in the direction orthogonal to the conveying direction of the sheet bundle T (the depth direction of the image forming system 1). Furthermore, the first binding unit 510 is moved to the middle portion of the sheet bundle T and one end portion of the sheet bundle T and binds the sheet bundle T. Likewise, the second binding unit 520, which is provided on the other side, that is, the rear side (the back side of the image forming system 1), is supported by the device frame 530 and can move in the direction orthogonal to the conveying direction of the sheet bundle T. Moreover, the second binding unit 520 is moved to the middle portion of the sheet bundle T and the other end portion of the sheet bundle T and binds the sheet bundle T.

That is, the binding device 500 is provided with a moving mechanism (not shown) that moves the first and second binding units 510 and 520. Further, the first and second binding units 510 and 520 are adapted to be moved in the direction orthogonal to the conveying direction of the sheet bundle T by motors M (see FIG. 3) provided in the moving mechanism or guides (not shown) or the like. In this exemplary embodiment, there is provided a configuration where two motors M corresponding to the respective first and second binding units 510 and 520 are disposed. Other than the configuration where the two motors M are disposed, the first and second binding units 510 and 520 may be adapted to be moved by one (single) motor M using a rack and a pinion.

<Description of Configuration of Binding Device>

Subsequently, the configuration of the first and second binding units 510 and 520 of the binding device 500 will be described. Meanwhile, since the first and second binding units 510 and 520 have the same configuration, the first binding unit 510 will be described here as an example.

First, as shown in FIG. 2, the first binding unit 510 includes an upper frame 511 and a lower frame 512 that is disposed below the upper frame 511 in the vertical direction with a gap KG therebetween. Further, the lower frame 512 of the first binding unit 510 is provided with a rotating plate 513 that is rotated about a predetermined shaft (to be described below) as a center.

As shown in FIG. 2, a moving frame 511A and a moving mechanism (not shown) are provided in the upper frame 511. The moving frame 511A reciprocates in a direction facing the lower frame 512 (substantially in a normal direction of the surface of the lower frame 512), and the moving mechanism moves the moving frame 511A. A sheet reference member 511B serving as an example of a reference member and a coil spring KS are provided in the moving frame 511A. As the moving frame 511A is moved toward the lower frame 512, the sheet reference member 511B protrudes toward the gap KG and serves as an alignment reference of the sheet bundle T having entered the gap KG. When the sheet reference member 511B bumps against the lower frame 512, the coil spring KS itself is compressed so as to suppress breakage or the like of the sheet reference member 511B. Further, a binding section 511C serving as an example of a binding section and a drive mechanism (not shown) are provided in the moving frame 511A. The binding section 511C performs binding processing on the sheet bundle T by using a punching member 505 (which will be described in detail below) or the like, and the drive mechanism drives the punching member 505 or the like.

Meanwhile, a hole portion 512A where the punching member 505 of the moving frame 511A enters is formed at the lower frame 512 as shown in FIG. 2. Further, a waste storage unit 512B, which stores waste generated as binding processing is performed by the binding section 511C of the upper frame 511, is provided in the lower frame 512 so as to be connected to the hole portion 512A. Furthermore, a protruding member 512C is provided in the lower frame 512 as shown in FIG. 2. The protruding member 512C serves as an example of a support member that supports the sheet bundle T entering the gap KG and separates the sheet bundle T from the upper surface of the lower frame 512 by protruding into the gap KG from the upper surface of the lower frame 512 (see FIG. 3). The protruding member 512C separates the sheet bundle T from the upper surface of the lower frame 512, so that the protruding member 512C suppresses catching of the sheet bundle T, which enters the gap KG, at the hole portion 512A.

In the binding device 500, the rotating plate 513 is received in the lower frame 512 as shown in FIG. 3. That is, an outer frame of the lower frame 512 is formed of an upper plate 512E and a lower plate (not shown), and a recess in which the rotating plate 513 can be received is formed in an internal space between the upper plate 512E and the lower plate. As each of the first and second binding units 510 and 520 is moved by a mechanism of the binding device 500 to be described subsequently, the rotating plate 513 is received in the recess.

As shown in FIG. 3, the rotating plate 513 is adapted to be capable of being rotated about a shaft 512D, which is provided close to the main body frame 36, as a center. In addition, there is provided a first coil spring KS1 of which one end is fixed to a portion of the rotating plate 513 close to the main body frame 36 and the other end is fixed to the lower surface of the upper plate 512E of the lower frame 512. Accordingly, a portion of the rotating plate 513, which is closer to the main body frame 36 than the shaft 512D, is pulled toward the lower frame 512 (in the direction orthogonal to the conveying direction of the sheet bundle T) by the first coil spring KS1.

Further, the binding device 500 is provided with support members 512F and protruding pins 512G. The support member 512F includes an elongated hole NA at one end portion thereof, and supports the shaft 512D at the other end portion thereof. The protruding pin 512G protrudes into the elongated hole NA of the support member 512F from the lower surface of the upper plate 512E. A second coil spring KS2 is provided in the elongated hole NA of the support member 512F. The second coil spring KS2 is provided so as to be closer to the shaft 512D than the protruding pin 512G, and moves the support member 512F in a direction where the support member is separated from the protruding pin 512G. Furthermore, there are provided guides G that are disposed on both sides of the support member 512F and guide the support member 512F being moved.

Moreover, in the binding device 500, a first regulating part 401 for regulating the rotation of the rotating plate 513 is mounted on the device frame 530 (see FIG. 2) so as to protrude into a conveying path of the rotating plate 513. In addition, a second regulating part 402 is provided so as to protrude upward from the lower plate (not shown) of the lower frame 512. Further, the second regulating part 402 regulates the rotation of the rotating plate 513 by bumping against a protrusion TK that is formed on the lower surface of the rotating plate 513.

In the binding device 500, the punching member 505 (see FIG. 2) provided in the binding section 511C of the upper frame 511 enters the hole portion 512A formed at the lower frame 512. For this reason, there is a concern that the punching member 505 and the rotating plate 513 interfere with each other. Accordingly, a notch 513A is formed at the rotating plate 513 of the binding device 500 as shown in FIG. 3, so that the interference between the punching member 505 and the rotating plate 513 is suppressed.

<Description of Binding Processing>

Figure 4A:
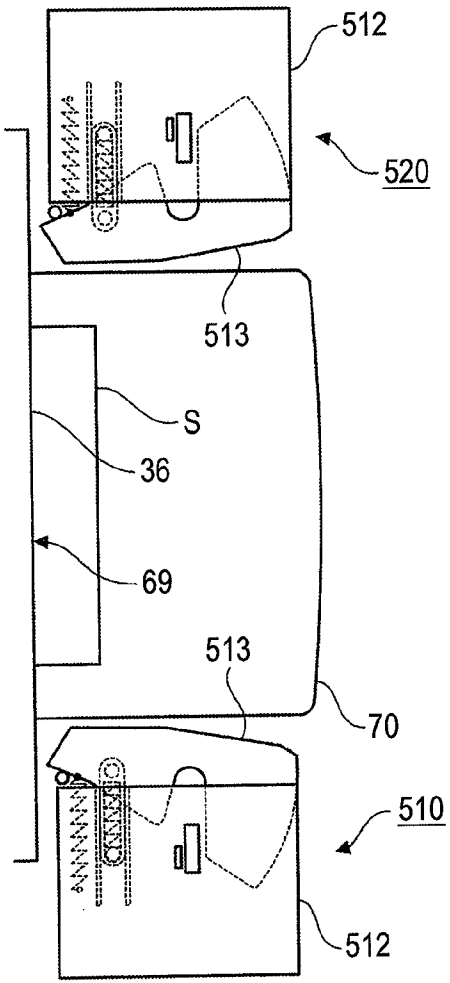
FIGS. 4A to 4C are views showing the states of first and second binding units as seen from above.
Figure 4B:
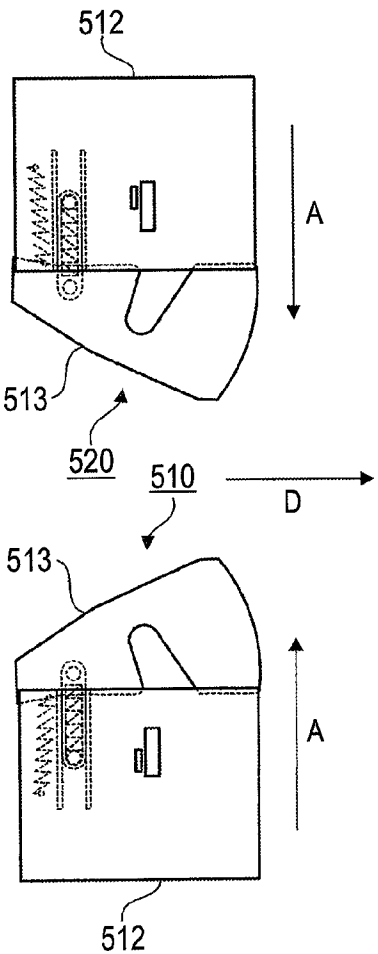
Figure 4C:
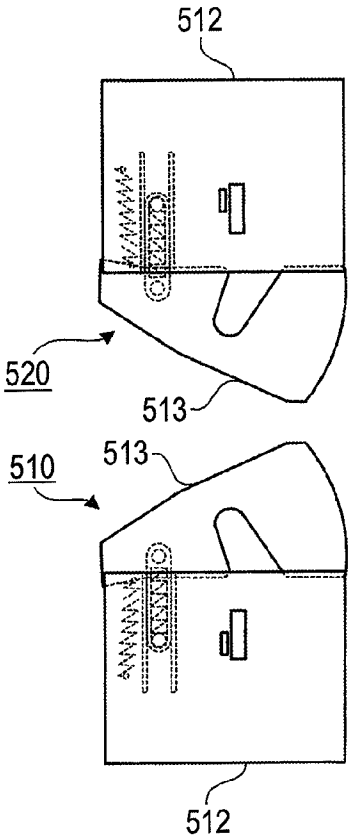

In the sheet processing apparatus 3 of this exemplary embodiment, any one or both of the binding processing that is performed using staples by the stapler 40 and the binding processing that is performed through the deformation of the sheet bundle T in the thickness direction by the binding device 500 are performed according to the selection of a user. The binding processing performed by the stapler 40 and the binding processing performed by the binding device 500 will be described below with reference to FIGS. 4A to 13. Meanwhile, FIGS. 4A to 4C are views showing the states of the first and second binding units 510 and 520 as the first and second binding units 510 and 520 are seen from above. Further, FIGS. 5A to 7 and FIG. 13 are perspective views of the first binding unit 510 and the like. Furthermore, FIGS. 8A to 12B are views showing the first binding unit 510 as seen from the front side of the image forming system 1.

<Description of Binding Processing Performed by Stapler>

First, the binding processing performed by the stapler 40 will be described.

When binding processing is performed by the stapler 40, the sheet bundle stacking unit 70 (see FIG. 1) is moved up. Further, a sheet S is taken out toward the sheet stacking unit 35 by the exit rollers 34 (see FIG. 1), and plural sheets S are stacked on the sheet stacking unit 35. Here, when a sheet S is taken out toward the sheet stacking unit 35, the front end portion of the sheet S, which has been taken out, passes through an end portion 35C (see FIG. 1) of the sheet stacking unit 35 and the opening 69 of the main body frame 36 and protrudes from the main body frame 36 as shown in FIG. 4A. Further, even after the rear end portion of the sheet S is placed on the sheet stacking unit 35 and the sheet S slides on the sheet stacking unit 35 until the rear end portion of the sheet S bumps against the end guide 35B (see FIG. 1), the sheet is stacked on the sheet stacking unit 35 while the front end portion of the sheet S protrudes from (the opening 69 of) the main body frame 36.

For this reason, the sheet bundle stacking unit 70 is moved up first in this exemplary embodiment, so that the front end portion of the sheet S protruding from the main body frame 36 is supported by the sheet bundle stacking unit 70. In this state, the sheet S is supported while spanning both the sheet stacking unit 35 and the sheet bundle stacking unit 70. In this way, not a configuration where the entire sheet S is received in the main body frame 36 but a configuration where the sheet S is supported while the front end portion of the sheet S protrudes from the main body frame 36 as described above has been employed in this exemplary embodiment. Accordingly, reduction is achieved in the size of the main body frame 36, and an area occupied by the entire image forming system 1 is further reduced.

Meanwhile, if the rotating plate 513 protrudes when binding processing is performed by the stapler 40, the movement of a sheet S or the movement of a sheet bundle T to be described below is regulated by the rotating plate 513. Further, there is a concern that the rotating plate 513 interferes with the sheet bundle stacking unit 70 being moved up. For this reason, when binding processing is performed by the stapler 40 in this exemplary embodiment, as shown in FIG. 4A, the first binding unit 510 is made to retract to the front side (front) of the image forming system 1 and the second binding unit 520 is made to retract to the rear side (back) of the image forming system 1. That is, the first binding unit 510 is made to retract to one side of the conveying path of a sheet bundle T that is taken out from the sheet stacking unit 35 by the exit rollers 34 (see FIG. 1), and the second binding unit 520 is made to retract to the other side of the conveying path of the sheet bundle T.

Meanwhile, when sheets S are sequentially taken out onto the sheet stacking unit 35 by the exit rollers 34, the side portions of the sheets S are pushed by the tampers 38 (see FIG. 1). Accordingly, the sheets S are aligned in the width direction of the sheet. Further, the sheets S are pushed against the end guide 35B by the paddle 37 (see FIG. 1) to be rotationally driven, so that the sheets S are aligned in the conveying direction of the sheet. Accordingly, a sheet bundle T, which is formed of a predetermined number of sheets S of which the end portions in the width direction and the conveying direction have been aligned, is prepared on the sheet stacking unit 35. After that, binding processing is performed on the sheet bundle T by the stapler 40. Then, the sheet bundle T is taken out to the sheet bundle stacking unit 70 by the ejection roller 39. Meanwhile, in this exemplary embodiment, the sheet bundle stacking unit 70 is adapted to be moved down according to the amount of stacked sheet bundles T as sheet bundles T are stacked on the sheet bundle stacking unit 70.

<Description of Binding Processing Performed by Binding Device>

Next, the binding processing, which is performed through the deformation of a sheet bundle T in the thickness direction by the binding device 500, will be described.

Figure 5A:
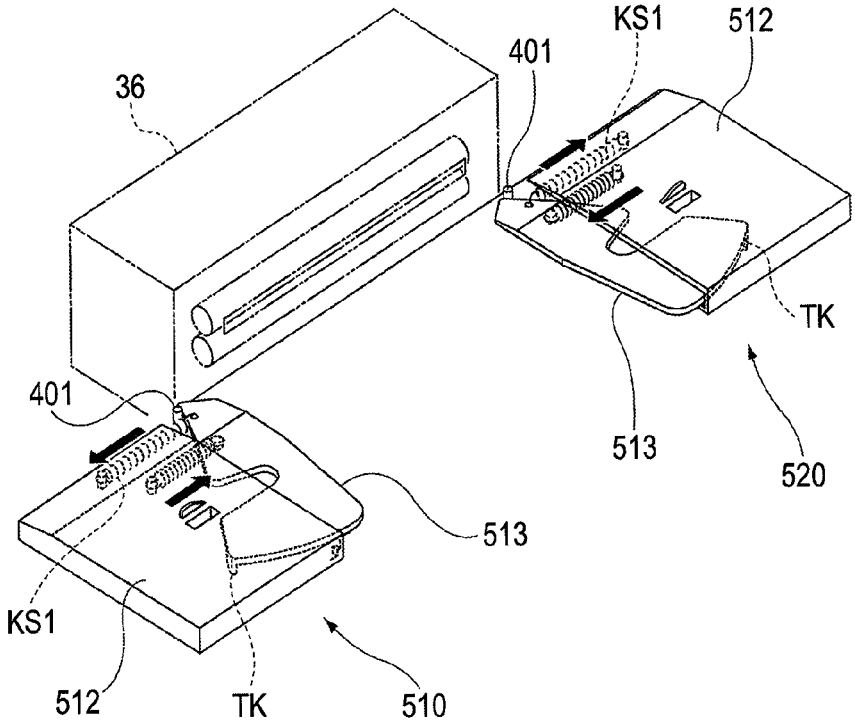
Figure 5B:
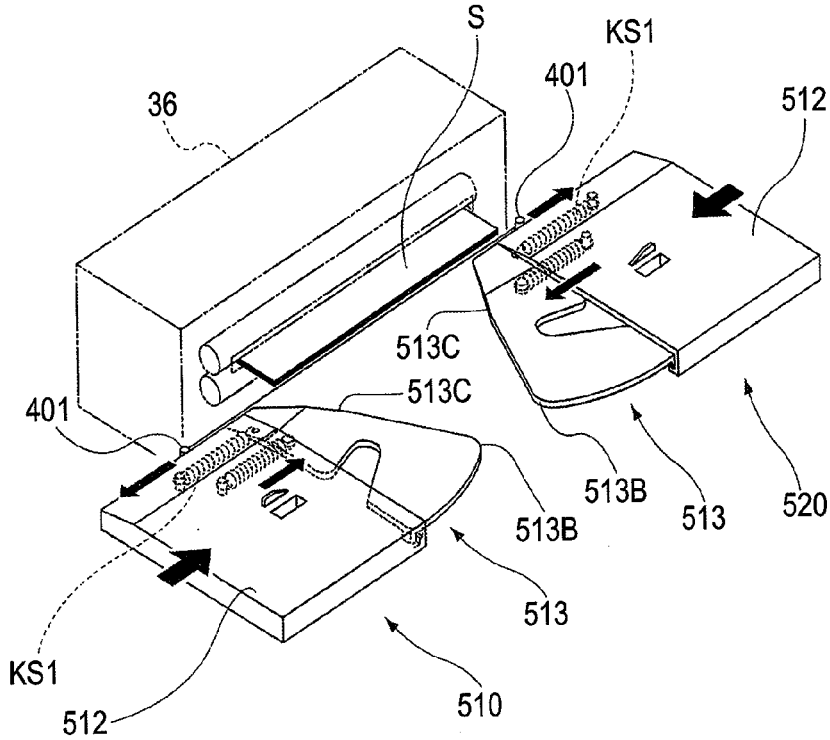

When binding processing is performed by the binding device 500, the sheet bundle stacking unit 70 is moved down to a position where the first and second binding units 510 and 520 do not interfere with the sheet bundle stacking unit 70. After that, as shown by an arrow A of FIG. 4B, the first and second binding units 510 and 520 are moved in a direction where the first and second binding units approach each other toward the inside of the stacking area of a sheet bundle T, that is, a direction where the first and second binding units approach each other in a direction orthogonal to a conveying path D of a sheet bundle T. In this case, as the first and second binding units 510 and 520 are moved, the regulation of the rotating plates 513 (see FIG. 5A) performed by the first regulating parts 401 is released. Accordingly, the rotating plates 513 are rotated by the first coil springs KS1, so that the rotating plates 513 protrude from the lower frames 512 as shown in FIG. 5B. When the rotating plates 513 protrude, the front end portion (see FIG. 5B) of the sheet S protruding from the main body frame 36 is supported by the rotating plates 513. That is, when binding processing is performed by the binding device 500, sheets S sequentially conveyed by the exit rollers 34 are supported while spanning both the sheet stacking unit 35 and the rotating plates 513. Therefore, the sheet stacking unit 35 and the rotating plate 513 form a recording medium stacking unit on which sheets S are stacked as sheet bundles T.

The protrusions TK (see FIG. 5A) formed on the rotating plates 513 bump against the second regulating parts 402 (see FIG. 3) formed on the lower frames 512, so that the rotation of the rotating plates 513 rotated by the first coil springs KS1 is stopped. Further, when sheets S are sequentially conveyed toward the sheet stacking unit 35 by the exit rollers 34, the rotating plates 513 are positioned on the downstream side on the conveying path of the sheet S but the lower frames 512 are set to be positioned outside the conveying path as shown in FIG. 5B. Furthermore, although not shown, the upper frames 511 are also set to be positioned outside the conveying path. Accordingly, the upper and lower frames 511 and 512 of the respective first and second binding units 510 and 520 do not obstruct the conveyance of a sheet S toward the sheet stacking unit 35 that is performed by the exit rollers 34.

Here, when sheets S are sequentially conveyed toward the sheet stacking unit 35 by the exit rollers 34, the upper and lower frames 511 and 512 may be disposed on the conveying path of the sheet S. In this case, although a sheet S varies according to the size thereof, a sheet S conveyed by the exit rollers 34 is moved toward the end guide 35B (see FIG. 1) of the sheet stacking unit 35 while sliding on the sheet stacking unit 35 and the rotating plates 513 after entering the gap KG (see FIG. 2) between the upper and lower frames 511 and 512 once.

Meanwhile, the sheets S sequentially conveyed toward the sheet stacking unit 35 may be curled. If the curled sheet S enters the gap KG of the binding device 500, the sheet S may be caught by the lower surface of the upper frame 511 or the upper surface of the lower frame 512. For this reason, there is a concern that the conveyance of the sheet S toward the end guide 35B is regulated. In addition, the sheets S of a sheet bundle T may not be aligned.

Further, when a sheet S has already been stacked on the sheet stacking unit 35, a sheet S newly conveyed toward the sheet stacking unit 35 enters the gap KG of the binding device 500 after sliding on the upper surface of the sheet S having already been stacked on the sheet stacking unit 35 and the rotating plates 513. Even when a new sheet S slides on the sheet S having already been stacked as described above, the sheet S is apt to come into contact with the lower surface of the upper frame 511 in the gap KG. Furthermore, even in this case, the conveyance of the sheet S toward the end guide 35B is apt to be regulated.

When sheets S are sequentially conveyed toward the sheet stacking unit 35, the first and second binding units 510 and 520 including the upper and lower frames 511 and 512 are set to positions where the first and second binding units retract from the conveying path of a sheet S for this reason in this exemplary embodiment as described above. That is, the first binding unit 510 is made to retract to one side of the conveying path of a sheet S (one side in the direction orthogonal to the conveying path D), and the second binding unit 520 is made to retract to the other side of the conveying path of the sheet S.

Further, when a predetermined number of sheets S are supported as sheet bundles T while spanning both the sheet stacking unit 35 and the rotating plates 513 and the end portions of the sheet bundle T in the width direction and the conveying direction have been aligned, the sheet stacking unit 35 is moved toward the binding device 500. Accordingly, the front end portion of the sheet bundle T placed on the sheet stacking unit 35 is moved toward a position where the first and second binding units 510 and 520 perform binding processing. After that, the first and second binding units 510 and 520 are moved in a direction A orthogonal to the conveying path D of a sheet S (in the width direction of the sheet bundle T), and the first and second binding units 510 and 520 are set to a predetermined binding position in the direction A orthogonal to the conveying path D of a sheet S.

Meanwhile, although not described above, the rotating plates 513 of the first and second binding units 510 and 520 are formed in a triangular shape as shown in FIG. 3. Further, an apex 513B is formed at each of the rotating plates 513. When the rotating plates 513 are positioned on the conveying path of a sheet S, the apex 513B protrudes toward the other binding unit, that is, the first or second binding unit 510 or 520, as shown in FIG. 5B. Furthermore, edges 513C, which continue to the apexes 513B and are inclined with respect to the respective lower frames 512 toward the main body frame 36, are formed at the rotating plates 513, respectively.

Meanwhile, FIGS. 4B and 5B show an example of the disposition of the first and second binding units 510 and 520 when, for example, an A4-size sheet S is conveyed while the long side (long edge) of the A4-size sheet S is at the head (so-called "long edge feed": LEF). Here, when, for example, an A4-size sheet S is conveyed while the short side (short edge) of the A4-size sheet S is at the head (so-called "short edge feed": SEF), the first and second binding units 510 and 520 are disposed closer to each other as shown in FIG. 4C. Further, although not described above, the first and second binding units 510 and 520 are disposed in the binding device 500 of this exemplary embodiment so that the rotating plates 513 are positioned on the extended line of the sheet stacking unit 35 on the conveying path D of a sheet S as shown in FIG. 2.

The binding processing performed by the binding device 500 will continue to be described. When sheets S are taken out toward the sheet stacking unit 35, the side portions of the sheets S are pushed by the tampers 38 whenever the sheets S are taken out like as in the case of the binding processing performed by the stapler 40. Accordingly, the sheets S are aligned in the width direction of the sheet. Further, the sheets S are pushed against the end guide 35B by the paddle 37 to be rotationally driven, so that the sheets S are aligned in the conveying direction of the sheet. Accordingly, a sheet bundle T, of which the end portions in the width direction and the conveying direction have been aligned, is prepared on the sheet stacking unit 35. After that, the sheet stacking unit 35 slides along the conveying path D of a sheet S toward the binding device 500 (also see FIG. 2). Accordingly, the front end portion of the sheet bundle T placed on the sheet stacking unit 35 (the front end portion of the sheet bundle corresponding to the front side on the conveying path D of a sheet S) is moved to a predetermined position where binding processing is performed by the first and second binding units 510 and 520.

Figure 6A:
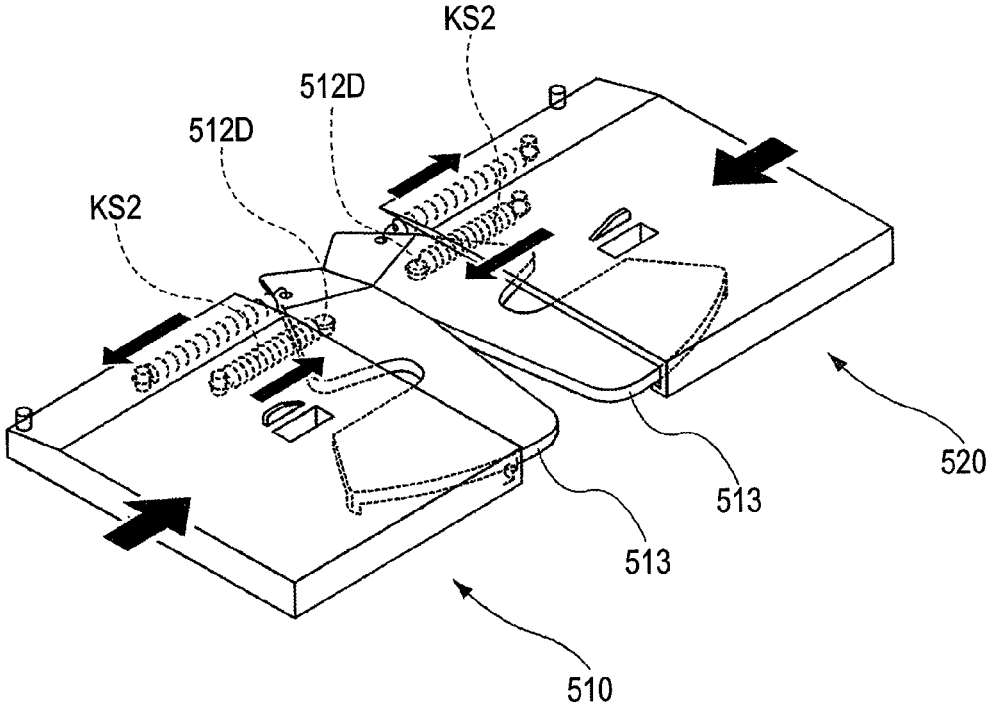
Figure 6B:
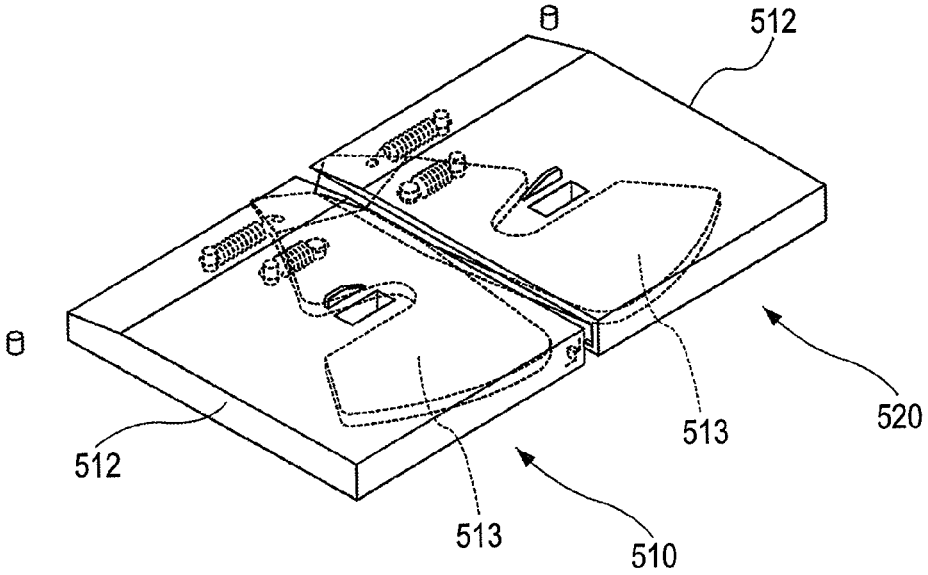

After that, for example, when binding processing is performed at two positions in the middle of sheets S (the middle of sheets S in the direction orthogonal to the conveying path D of a sheet S), the first and second binding units 510 and 520 further approach each other in the direction A (see FIG. 4B) orthogonal to the conveying path D of a sheet S as shown in FIG. 6A so as to enter the inside of the stacking area of a sheet bundle T that is supported by the sheet stacking unit 35 and the rotating plates 513. In this case, the rotating plates 513 of the first and the second binding units 510 and 520 bump against each other as shown in FIG. 6A. In addition, each of the rotating plates 513 is rotated about the shaft 512D. Further, as the first and second binding units 510 and 520 further approach each other, the second coil springs KS2 provided in the support members 512F (see FIG. 3) are compressed and the rotating plates 513 slide. Accordingly, as shown in FIG. 6B, the rotating plates 513 of the first and second binding units 510 and 520 are received in the lower frames 512, respectively.

Here, if the rotating plates 513 of the respective first and second binding units 510 and 520 are adapted not to be rotated, the rotating plates 513 of the respective first and second binding units 510 and 520 interfere with each other, so that the first and second binding units 510 and 520 are difficult to approach each other. For this reason, the rotating plates 513 of this exemplary embodiment are adapted to rotate and slide as described above. Accordingly, it may be possible to make the first and second binding units 510 and 520 approach a position where the first and second binding units can bind the middle portions of sheets S.

Figure 7:
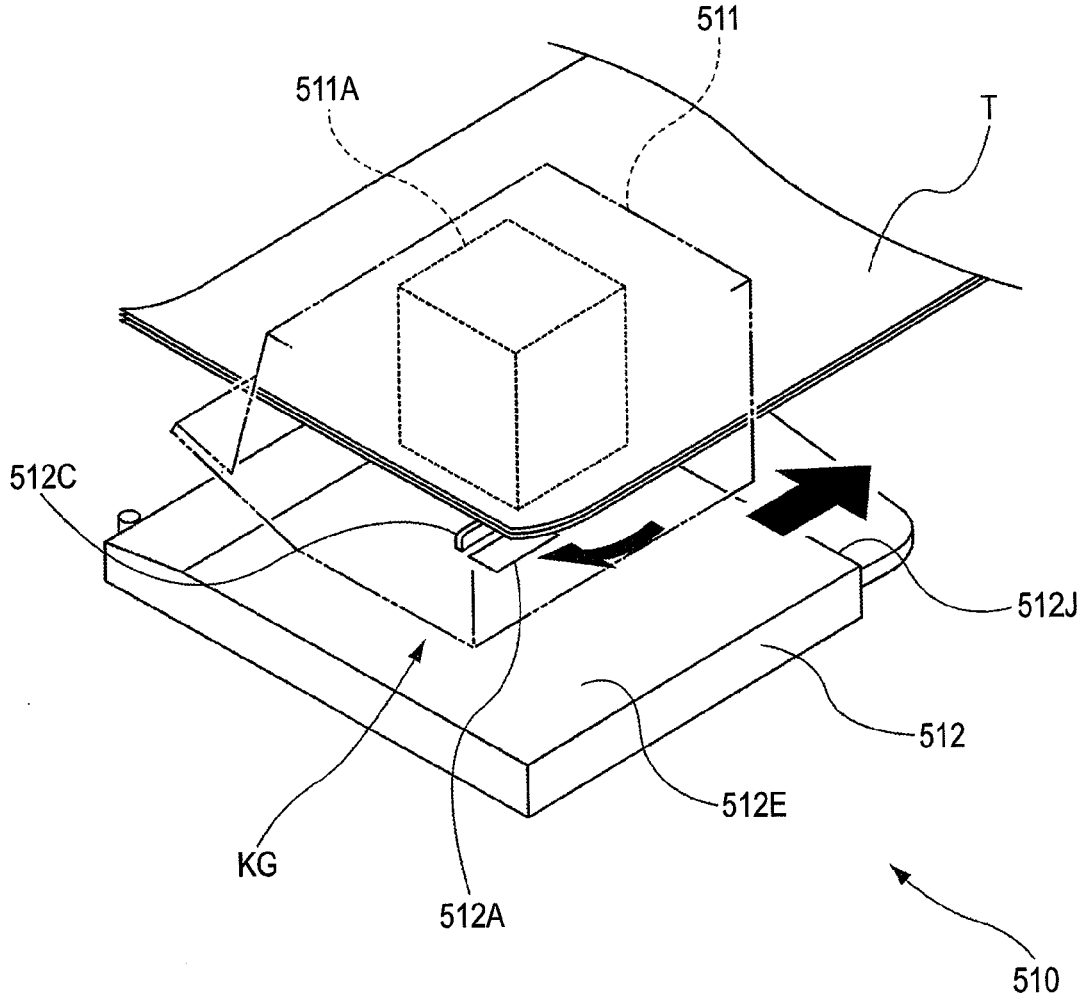

Subsequently, the first and second binding units 510 and 520 are further moved in a direction where the first and second binding units 510 and 520 approach each other (a direction of an arrow shown in FIGS. 5A and 5B and FIGS. 6A and 6B), so as to enter the inside of the stacking area of a sheet bundle T that is supported by the sheet stacking unit 35 and the rotating plates 513. Accordingly, there is set a state where a sheet bundle T enters the gap KG between the upper and lower frames 511 and 512 of each of the first and second binding units 510 and 520 as shown in FIG. 7. Here, as described above, the hole portion 512A is formed at the upper surface of each of the lower frames 512 (also see FIG. 3). For this reason, there is a concern that the sheet bundle T entering each gap KG is caught by the hole portions 512A of the respective lower frames 512 when the first and second binding units 510 and 520 are moved in a direction where the first and second binding units approach each other.

Meanwhile, the first and second binding units 510 and 520 include protruding members 512C that protrude from the upper surfaces of the lower frames 512 into the gap KG (also see FIG. 2). Accordingly, when a sheet bundle T enters the gap KG of each of the lower frames 512 due to the movement of the first and second binding units 510 and 520, the protruding members 512C are set so that the protruding members lift the sheet bundle T and the sheet bundle T floats from the upper surface of each of the lower frames 512. Therefore, the catching of a sheet bundle T at the hole portion 512A of each of the lower frames 512 is suppressed. Meanwhile, an end portion 512J or the like of the upper plate 512E of the lower frames 512 is chamfered to make the sheet bundle T enter the gap KG more smoothly. Further, portions of the protruding members 512C, which face each other in the direction A orthogonal to the conveying path D of a sheet bundle T, are formed of inclined surfaces that are inclined downward with respect to the lower frames 512 toward the center of the conveying path.

<Description of a Series of Operations when Binding Processing is Performed>

Next, there will be described a series of operations when the first and second binding units 510 and 520 perform binding processing in the case where the respective first and second binding units 510 and 520 are moved in the direction A (see FIG. 4B) orthogonal to the conveying path D of a sheet bundle T so that the sheet bundle T is set in each gap KG and the respective first and second binding units 510 and 520 reach a predetermined binding position.

FIGS. 8A to 12B are views illustrating a series of operations when the first binding unit 510 binds a sheet bundle T, as an example. Meanwhile, FIGS. 8A to 12B are views as the first binding unit 510 is seen from the front side of the image forming system 1 as described above.

When the sheet stacking unit 35 slides, a sheet bundle T, which is supported by the sheet stacking unit 35 and the rotating plates 513, is moved toward a position where the first and second binding units 510 and 520 perform binding processing (a binding position in a direction of the conveying path D of a sheet bundle T). Further, when the sheet stacking unit 35 reaches a predetermined position that exists on the front side of the binding position on the conveying path D of a sheet bundle T (the upstream side on the conveying path D), the sheet stacking unit 35 stops the sheet bundle T. Furthermore, when the sheet bundle T is set to the predetermined position that exists on the upstream side of the binding position on the conveying path D, the respective first and second binding units 510 and 520 start to move in the direction A (see FIG. 4B) orthogonal to the conveying path D of a sheet bundle T.

Here, when a sheet bundle T is set to a predetermined position that exists on the upstream side of the binding position on the conveying path D, the ejection roller 39 is moved to a position where the ejection roller 39 comes into contact with the sheet bundle T while the rotation of the ejection roller 39 is stopped, and the ejection roller 39 clamps the sheet bundle T. Accordingly, the ejection roller 39 suppresses the deviation of the position of the sheet bundle T or the misalignment of the sheet bundle T during the movement of the first and second binding units 510 and 520 by pressing the sheet bundle T.

Figure 8A:
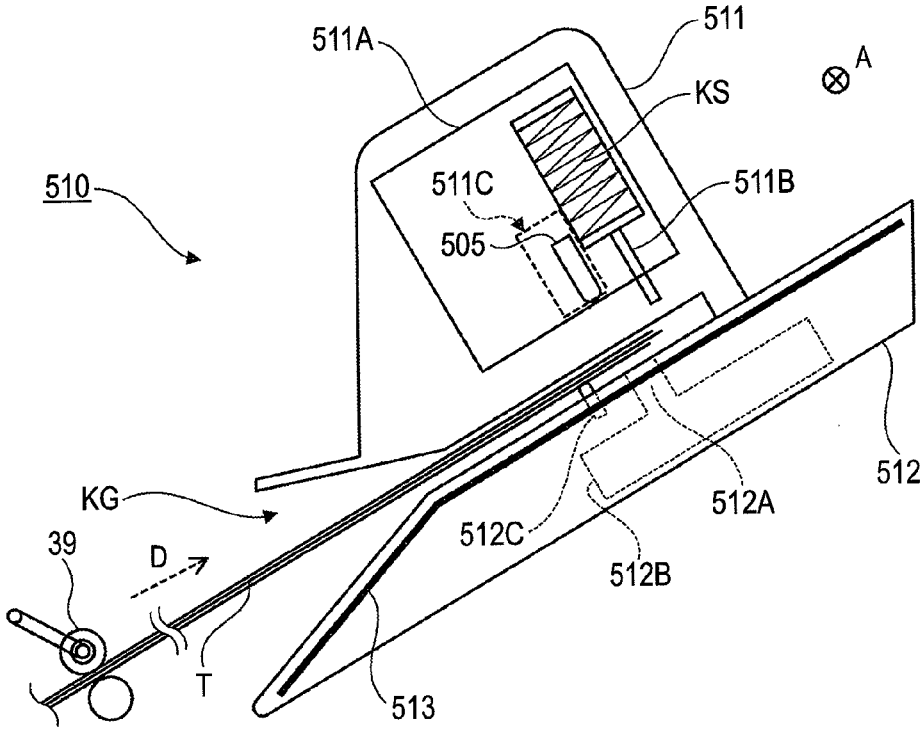
FIGS. 8A and 8B are views illustrating a series of operations when the first binding unit performs binding processing on a sheet bundle.

FIG. 8A shows a state where the first binding unit 510 is moving in the direction A until the first binding unit 510 reaches a predetermined binding position (a binding position in the direction A orthogonal to the conveying path D of a sheet bundle T) while making a sheet bundle T enter the gap KG. While the first binding unit 510 is moving until the first binding unit 510 reaches a predetermined binding position in the direction A as shown in FIG. 8A, the moving frame 511A is set to a position retracted (separated) from the gap KG so as to maintain a gap from the sheet bundle T that is positioned in the gap KG. In addition, the protruding member 512C is set to a position where the protruding member lifts a sheet bundle T, and maintains the sheet bundle T so that the sheet bundle floats (is separated) from the upper surface of the lower frame 512. Therefore, the catching of the sheet bundle T at the hole portion 512A of the lower frames 512 is suppressed.

Further, the sheet reference member 511B, which is provided in the first binding unit 510, is set to a position that is separated from the front end portion of a sheet bundle T in the direction of the conveying path D (see FIG. 4B) of the sheet bundle T. That is, the sheet reference member 511B of the first binding unit 510 is set to a position existing on the downstream side of the front end portion of a sheet bundle T, which is set to a predetermined position existing on the upstream side of a binding position on the conveying path D, on the conveying path D. Accordingly, when an operation for aligning the front end portion of a sheet bundle T (the front end portion of a sheet bundle T on the conveying path D of the sheet bundle T), which is an operation to be subsequently performed, is performed, a sheet bundle T is not interposed (pressed) between the sheet reference member 511B and the lower frame 512 even though the sheet reference member 511B protrudes toward the lower frame 512 (see the following FIG. 8B).

After that, when the first binding unit 510 reaches a predetermined binding position (a binding position in the direction A), the first binding unit 510 performs an operation for aligning the front end portion of a sheet bundle T (the front end portion of the sheet bundle corresponding to the front side on the conveying path D (see FIG. 4B) of a sheet bundle T).

Figure 8B:
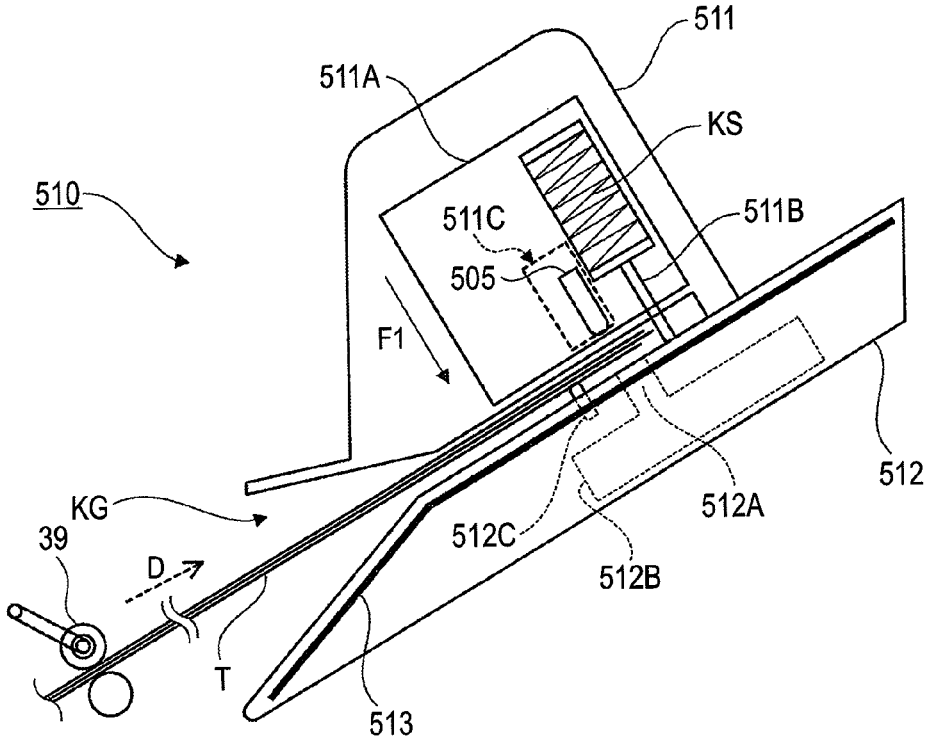
Figure 9A:
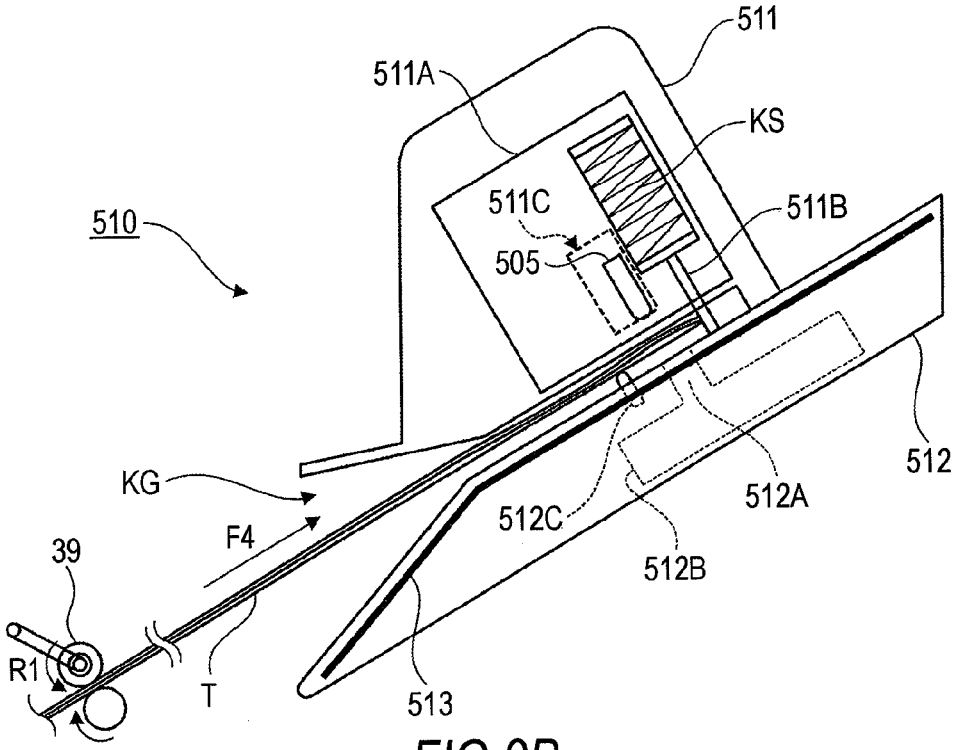
FIGS. 9A and 9B are views illustrating a series of operations when the first binding unit performs binding processing on a sheet bundle.

FIGS. 8B and 9A are views illustrating an operation for aligning the front end portion of a sheet bundle T that is performed by the first binding unit 510. As shown in FIG. 8B, the moving frame 511A provided in the upper frame 511 is moved toward the lower frame 512 (in a direction F1) by a predetermined distance. Accordingly, an end of the sheet reference member 511B protrudes so as to come into contact with the upper surface of the lower frame 512 in the gap KG of the first binding unit 510. As described above, the sheet reference member 511B is set to a position that exists on the downstream side of the front end portion of a sheet bundle T in a direction of the conveying path D of a sheet bundle T. For this reason, even though the end portion of the sheet reference member 511B protrudes so as to come into contact with the upper surface of the lower frame 512, a sheet bundle T is not interposed (pressed) between the sheet reference member 511B and the lower frame 512.

While the end portion of the sheet reference member 511B comes into contact with the upper surface of the lower frame 512 as shown in FIG. 9A, the ejection roller 39 (see also FIG. 1) functioning as an alignment unit, which is set to a position where the ejection roller 39 comes into contact with a sheet bundle T while the rotation of the ejection roller 39 is stopped, is rotated again in a rotational direction R1. Accordingly, as shown in FIG. 9A, the sheet bundle T is moved in a direction where the sheet reference member 511B is disposed (in a direction F4=toward the downstream side on the conveying path D) and the front end portion of the sheet bundle T bumps against the side surface of the sheet reference member 511B. Accordingly, the front end portions of the sheets S of the sheet bundle T are pressed against the side surface of the sheet reference member 511B.

Figure 9B:
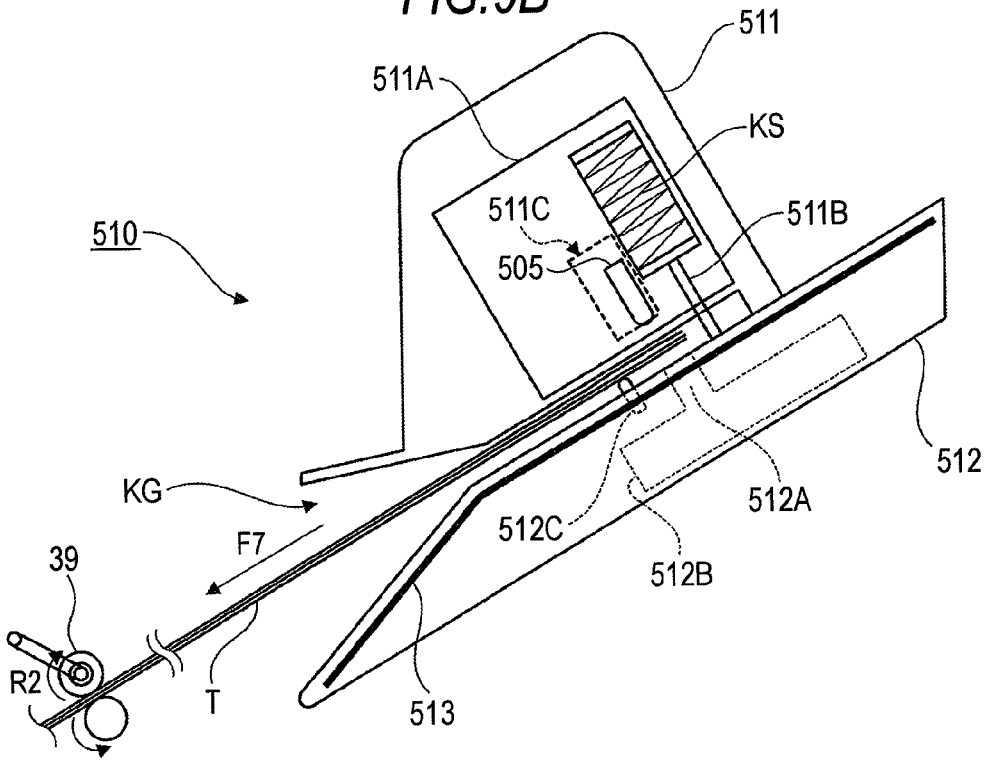

After that, as shown in FIG. 9B, the ejection roller 39 is reversely rotated in a rotational direction R2 opposite to the rotational direction R1 by a predetermined angle. Accordingly, a sheet bundle T is moved in a direction away from the direction where the sheet reference member 511B is disposed (in a direction F7=toward the upstream side on the conveying path D), and is stopped.

Figure 10A:
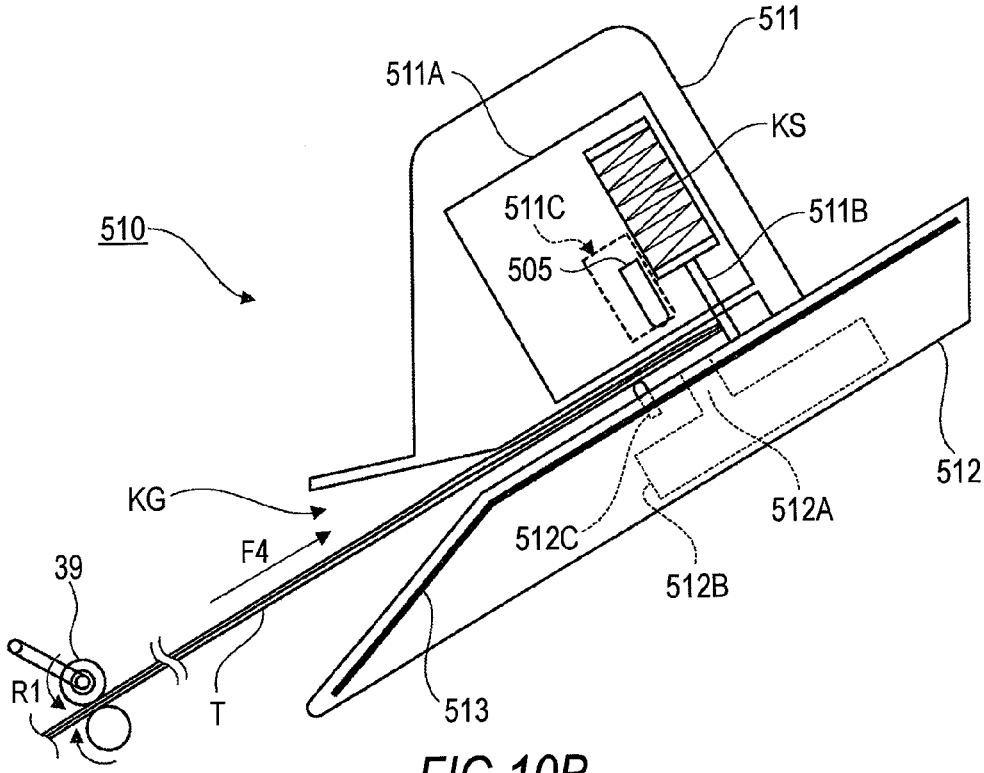
FIGS. 10A and 10B are views illustrating a series of operations when the first binding unit performs binding processing on a sheet bundle.

Further, as shown in FIG. 10A, the ejection roller 39 is rotated again in the rotational direction R1. Accordingly, a sheet bundle T is moved again in the direction where the sheet reference member 511B is disposed (in the direction F4=toward the downstream side on the conveying path D) and the front end portion of the sheet bundle T is pressed against the side surface of the sheet reference member 511B.

If an operation, which makes the front end portion of a sheet bundle T bump against the side surface of the sheet reference member 511B by the ejection roller 39, is repeated several times, the front end portions of the respective sheets S are aligned by the side surface of the sheet reference member 511B. As a result, the entire sheet bundle T is aligned. In particular, if an operation, which presses a sheet bundle T against the side surface of the sheet reference member 511B by the ejection roller 39, is repeated several times, the entire sheet bundle T is aligned with higher accuracy.

Meanwhile, an operation, which makes the front end portion of a sheet bundle T bump against the side surface of the sheet reference member 511B, may be performed only one time to shorten the time taken to align the front end portion of a sheet bundle T.

The ejection roller 39 is rotated as described above in the sheet processing apparatus 3 of this exemplary embodiment, so that the front end portion of a sheet bundle T, which has been stopped on the front side of a position where binding processing is performed (on the upstream side on the conveying path D), bumps against the side surface of the sheet reference member 511B and is pressed in a lateral direction (direction F4) of the sheet reference member 511B. Accordingly, the entire front end portion, which is to be bound, of the sheet bundle T is aligned. In this case, so as not to obstruct the conveyance of a sheet bundle T that is performed by the ejection roller 39, the sheet reference member 511B provided in the first binding unit 510 is disposed at a position where a sheet bundle T is not interposed (not pressed) between the sheet reference member 511B and the lower frame 512. Therefore, a sheet bundle T is smoothly moved toward the sheet reference member 511B by the ejection roller 39, so that alignment for aligning the front end portion of a sheet bundle T with high accuracy is performed.

Further, if an operation for pressing a sheet bundle T against the side surface of the sheet reference member 511B is repeated several times by the rotation of the ejection roller 39 in the normal and reverse directions, the entire sheet bundle T is aligned with higher accuracy.

Meanwhile, a position where the front end portion of a sheet bundle T bumps against the side surface of the sheet reference member 511B is a position where binding processing is performed by the first and second binding units 510 and 520 (a binding position in the direction of the conveying path D of a sheet bundle T). The position of the sheet reference member 511B is set in that way.

Figure 10B:
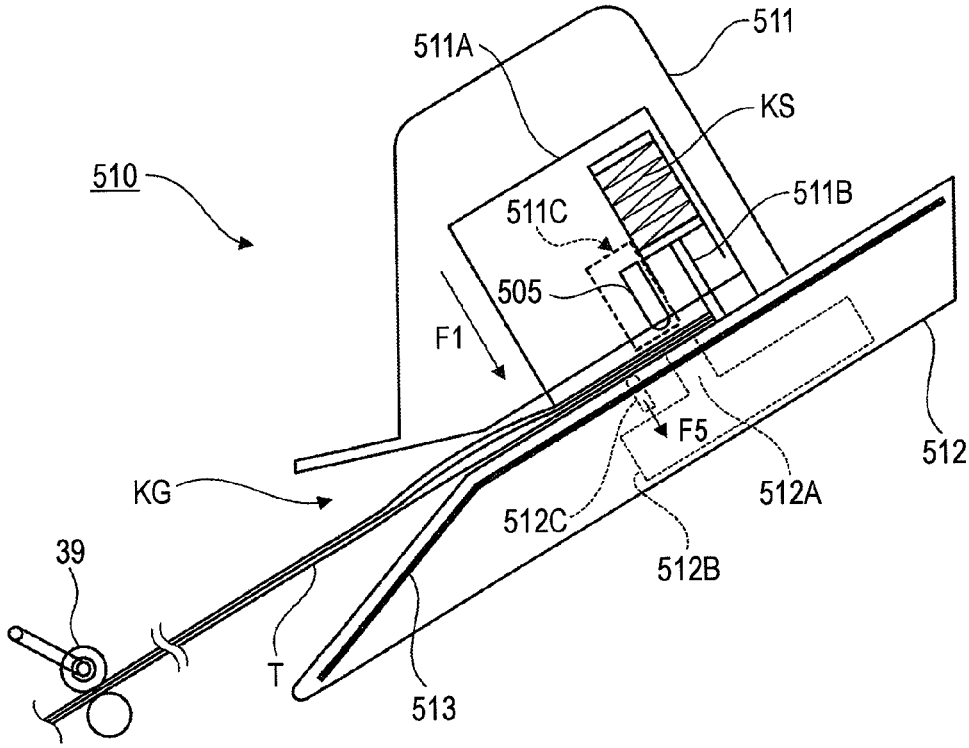
Figure 11A:
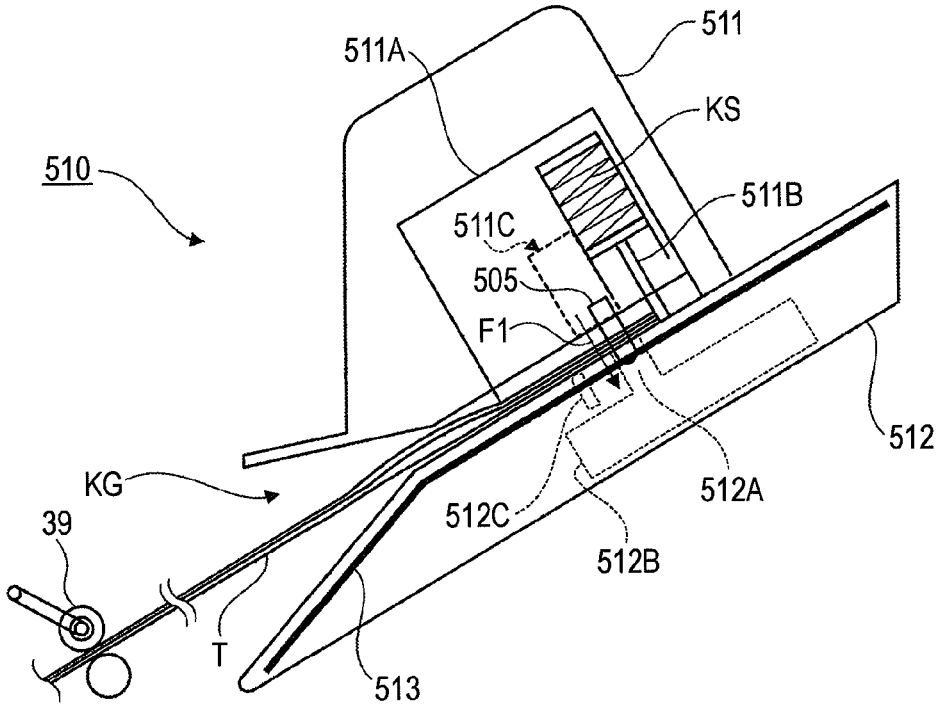
FIGS. 11A and 11B are views illustrating a series of operations when the first binding unit performs binding processing on a sheet bundle.

FIGS. 10B and 11A are views illustrating a binding operation that is performed by the moving frame 511A and the binding section 511C after the front end portion of a sheet bundle T is completely aligned by the ejection roller 39 and the sheet reference member 511B. When the front end portion of a sheet bundle T is completely aligned as shown in FIG. 10B, the moving frame 511A is moved toward the lower frame 512 (in the direction F1) to a position where the lower surface of the moving frame 511A functioning as a pressing member comes into contact with the upper surface of the lower frame 512. Further, a sheet bundle T set in the gap KG is interposed and pressed between the lower surface of the moving frame 511A and the upper surface of the lower frame 512.

In this case, as the moving frame 511A is moved toward the lower frame 512 (in the direction F1), the protruding member 512C is pushed by the lower surface of the moving frame 511A and thus is received in the lower frame 512 (in a direction F5). That is, the protruding member 512C is adapted to be biased toward the upper frame 511 by a spring member (not shown). For this reason, when the moving frame 511A is moved to a position where the lower surface of the moving frame 511A comes into contact with the upper surface of the lower frame 512, the protruding member 512C is received in the lower frame 512 against the pushing force of a spring member (not shown). Accordingly, the obstruction of the pressing of a sheet bundle T, which is caused by the protruding member 512C, is suppressed and a sheet bundle T is stably fixed between the lower surface of the moving frame 511A and the upper surface of the lower frame 512.

Figure 11B:
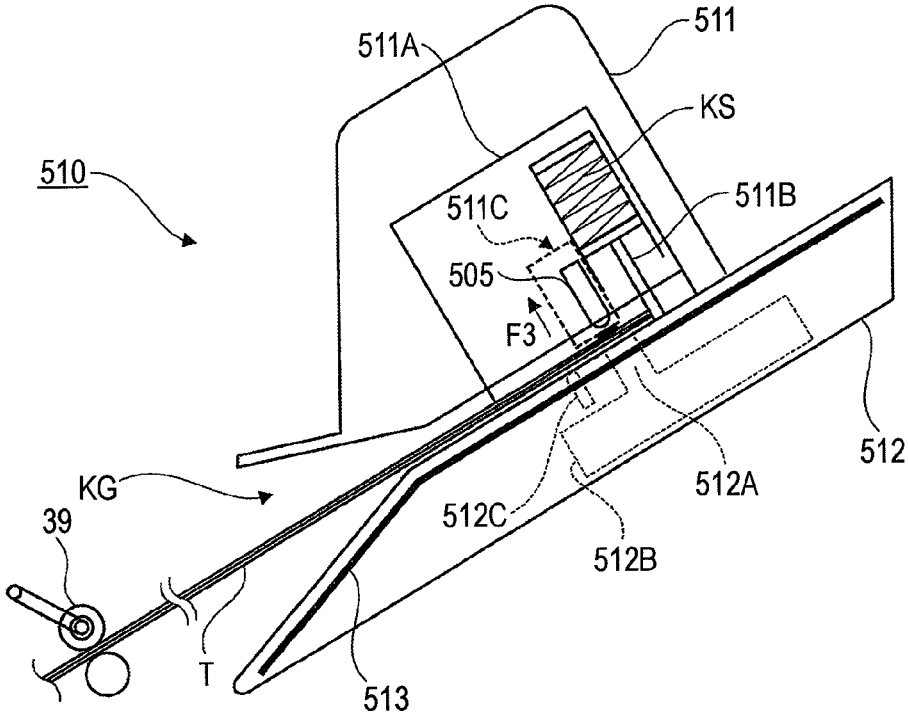

After a sheet bundle T is pressed by the lower surface of the moving frame 511A and the upper surface of the lower frame 512, the binding section 511C (the punching member 505 and the like) provided in the moving frame 511A is moved toward the lower frame 512 (in the direction F1) as shown in FIG. 11A and performs binding processing on the sheet bundle T. Further, when the binding processing has been completed on the sheet bundle T by the binding section 511C, the punching member 505 and the like of the binding section 511C retract toward the upper frame 511 from the lower frame 512 (in a direction F3) as shown in FIG. 11B while a sheet bundle T is pressed by the lower surface of the moving frame 511A and the upper surface of the lower frame 512.

In the sheet processing apparatus 3 of this exemplary embodiment, binding processing is performed on a sheet bundle T by the punching member 505 and the like of the binding section 511C while the sheet bundle T is pressed by the lower surface of the moving frame 511A and the upper surface of the lower frame 512. Accordingly, a gap (floatation) is not easily formed between sheets S in a sheet bundle T. Therefore, a binding force of a sheet bundle T is increased in the binding processing that is performed by the binding section 511C for binding sheets S through the deformation of a sheet bundle T in the thickness direction. That is, if floatation exists between sheets S, the deformation of a sheet bundle in the thickness direction is reduced at a portion where floatation exists between sheets. Accordingly, a binding force is reduced as a whole and a sheet bundle T is apt to loosen. However, in this exemplary embodiment, a sheet bundle T is deformed in the thickness direction while the sheet bundle T is pressed by the lower surface of the moving frame 511A and the upper surface of the lower frame 512 and floatation is reduced between the sheets S of the sheet bundle T. Accordingly, a portion, which is apt to loosen, is not easily formed at a bound sheet bundle T. As a result, the entire sheet bundle T is more strongly bound as one body, so that the loosening of the sheet bundle T is suppressed. In addition, even though the number of sheets S of a sheet bundle T is large, the sheet bundle T is hardly loosened. Further, since floatation is reduced in a sheet bundle T, the sheet bundle T is not easily loosened in the width direction of the sheet bundle T (the direction A (see FIG. 4B) orthogonal to the conveying path D of the sheet bundle T). Accordingly, deviation (misalignment) between sheets S is also suppressed at the end portions of the sheet bundle T in the width direction.

Figure 12A:
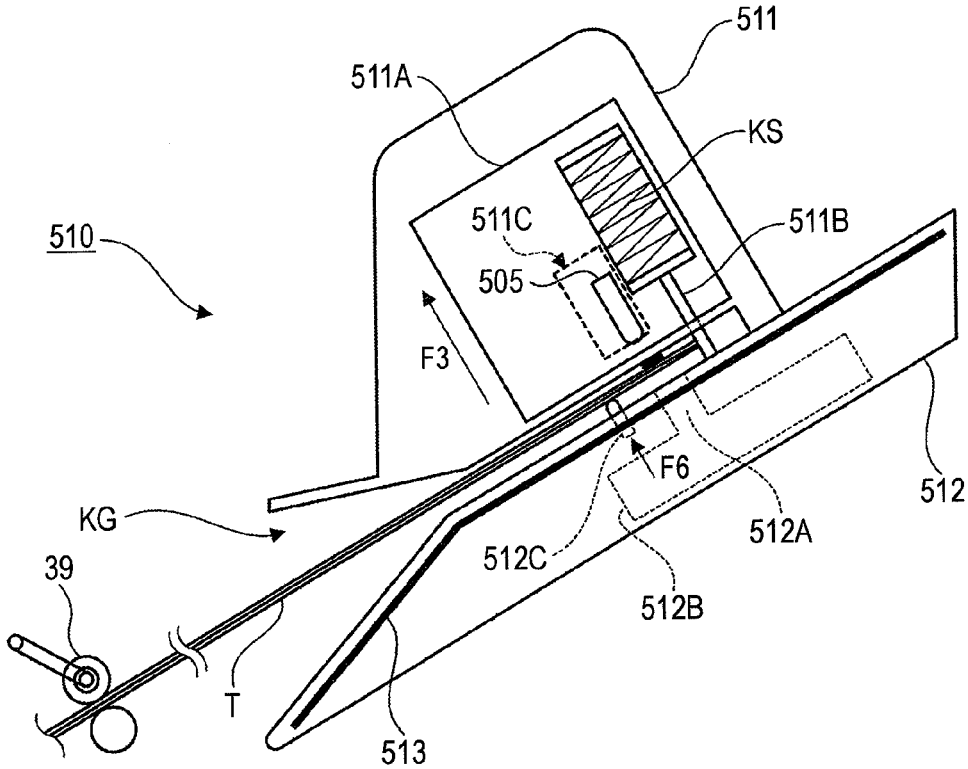
FIGS. 12A and 12B are views illustrating a series of operations when the first binding unit performs binding processing on a sheet bundle.
Figure 12B:
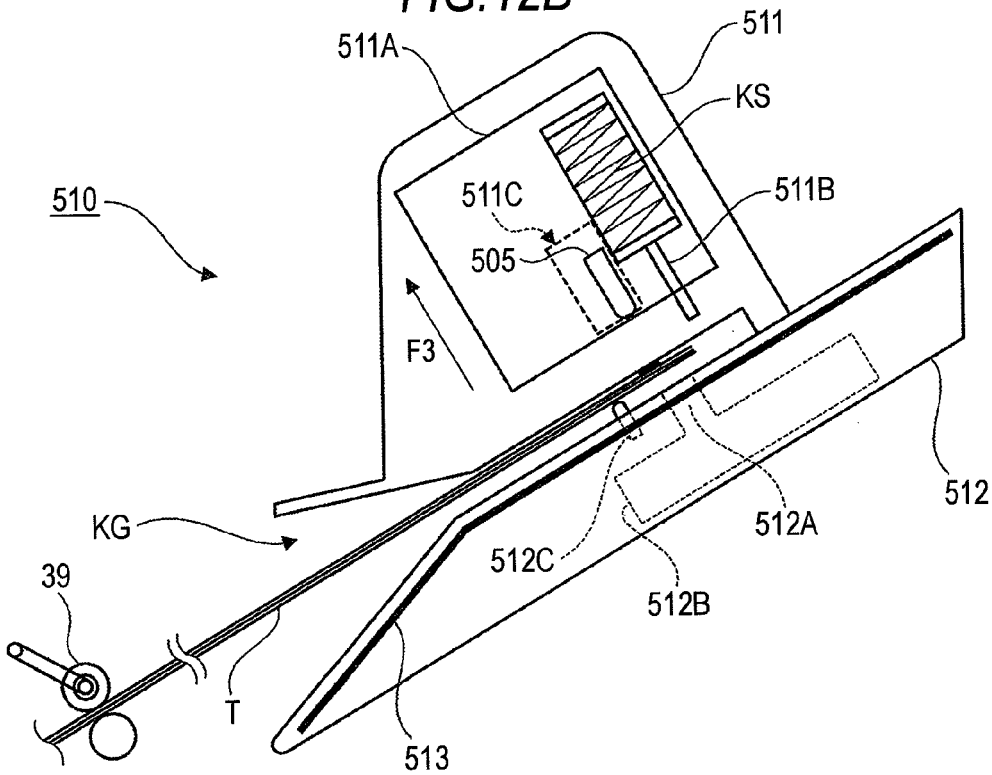

FIGS. 12A and 12B are views illustrating an operation after binding processing is completed on a sheet bundle T by the binding section 511C and the punching member 505 and the like of the binding section 511C retract from the lower frame 512. When binding processing has been completed on a sheet bundle T by the binding section 511C and the punching member 505 and the like of the binding section 511C retract from the lower frame 512 as shown in FIG. 12A, the lower surface of the moving frame 511A is moved toward the upper frame 511 from the lower frame 512 (in the direction F3) to a position where the lower surface of the moving frame 511A is separated from the upper surface of the lower frame 512. Accordingly, the pressing of a sheet bundle T, which is performed by the lower surface of the moving frame 511A, and the upper surface of the lower frame 512, is released and the sheet bundle T has a degree of freedom in the gap KG. Further, the lower surface of the moving frame 511A is moved to a position where the lower surface of the moving frame 511A is separated from the upper surface of the lower frame 512, so that the protruding member 512C protrudes upward (in a direction F6) again from the upper surface of the lower frame 512 by a spring member (not shown). Accordingly, the protruding member 512C is set so that the protruding member lifts a sheet bundle T and the sheet bundle T floats from the upper surface of each of the lower frames 512. Therefore, when the first binding unit 510 is moved later, the catching of a sheet bundle T at the hole portion 512A of each of the lower frames 512 is suppressed.

Further, as shown in FIG. 12B, the moving frame 511A is moved in a direction where the moving frame 511A is separated from the lower frame 512 (in the direction F3). Accordingly, the end of the sheet reference member 511B is moved to a position where the end of the sheet reference member 511B is separated from the upper surface of the lower frame 512.

Figure 13:
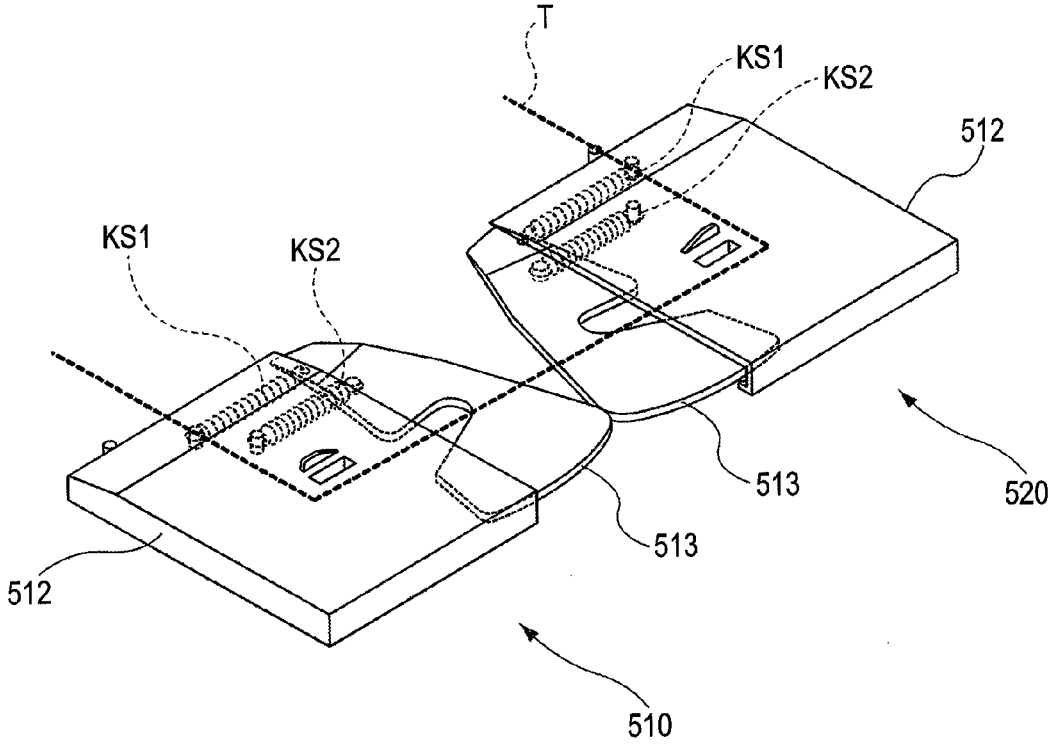

After that, the first binding unit 510 is moved toward the end portion of a sheet bundle T from the middle portion of a sheet bundle T in the direction A (see FIG. 4B) orthogonal to the conveying path D of a sheet bundle T, and is in a state shown in FIG. 13. That is, the first binding unit 510 is disposed at an opposite position corresponding to one end portion of a sheet bundle T.

A series of operations when the first binding unit 510 performs binding processing has been exemplified here, but the second binding unit 520 also performs the same operations.

Meanwhile, when the first and second binding units 510 and 520 are moved in a direction where the first and second binding units 510 and 520 are separated from each other, the rotating plates 513 of the respective first and second binding units 510 and 520 are pushed by the second coil springs KS2 and the end portions of the rotating plates 513 are pulled by the first coil springs KS1. Accordingly, the rotating plates 513 protrude from the lower frames 512 as shown in FIG. 13. For this reason, even though the first and second binding units 510 and 520 are moved in the direction where the first and second binding units 510 and 520 are separated from each other, the support of a sheet bundle T performed by the rotating plates 513 is maintained.

After that, the same operations as the operations illustrated in FIGS. 8A to 12B are performed again at a predetermined binding position that is closer to the end portion of a sheet bundle T than the middle portion of the sheet bundle T, so that binding processing is performed on the sheet bundle T. Accordingly, in this exemplary embodiment, binding processing is performed at a total of four positions by the first and second binding units 510 and 520. Meanwhile, a case where binding processing is performed at four positions has been exemplified above, but binding processing may be performed at only two positions at the middle portion of a sheet bundle T. Further, for example, binding processing may be performed at two positions, that is, at both end portions of a sheet bundle T or at one position, that is, at one end portion of a sheet bundle T.

In this exemplary embodiment, the first and second binding units 510 and 520 are further moved in the direction where the first and second binding units 510 and 520 are separated from each other, after binding processing is completed at an end portion of a sheet bundle T. Accordingly, the rotating plates 513 of the respective first and second binding units 510 and 520 are pushed by the second coil springs KS2 and the end portions of the rotating plates 513 are pulled by the first coil springs KS1, so that the rotating plates 513 protrude from the lower frames 512. As a result, the first and second binding units 510 and 520 return to a set state shown in FIG. 5B, that is, a set state where the first and second binding units retract to the outside of the stacking area of a sheet bundle T.

That is, when binding processing has been completed, the first and second binding units 510 and 520 are disposed so that the rotating plates 513 are positioned below the sheet bundle T and the upper and lower frames 511 and 512 are positioned on the sides of the sheet bundle T (retract to the sides of the sheet bundle). In this exemplary embodiment, as described below, a sheet bundle T is conveyed by the ejection roller 39 after the completion of the binding processing performed by the binding device 500 and falls into the sheet bundle stacking unit 70 from an open portion that is formed at a lower portion of the device frame 530 (see FIG. 2). For this reason, if the upper and lower frames 511 and 512 are positioned on the conveying path D of a sheet bundle T, a sheet bundle T bumps against a base portion 511K (see FIG. 2) of the upper frame 511, so that the conveyance of the sheet bundle T is obstructed. Accordingly, in this exemplary embodiment, the upper and lower frames 511 and 512 are positioned on the sides of a sheet bundle T by the completion of the binding processing.

After that, the ejection roller 39 starts to rotate and takes out the sheet bundle T on which binding processing has been completed by the binding device 500. More specifically, the ejection roller 39 conveys the sheet bundle T until the rear end portion of the sheet bundle T passes through the opening 69 (see FIG. 1). Accordingly, a sheet bundle T is set to a state where the sheet bundle T is supported only by the rotating plates 513 from a state where the sheet bundle T is supported by both the sheet stacking unit 35 and the rotating plates 513.

The rotating plates 513 of this exemplary embodiment are inclined like the sheet stacking unit 35. For this reason, there is a concern that a sheet bundle T, which has been conveyed to the rotating plates 513 by the ejection roller 39, returns to the sheet stacking unit 35. Accordingly, a portion of the rotating plate 513, which is positioned on the upstream side in the conveying direction of a sheet bundle T, is further inclined as shown in FIG. 2. That is, the portion of the rotating plate 513, which is positioned on the upstream side in the conveying direction of a sheet bundle T, is inclined further than a portion of the rotating plate that is positioned on the downstream side in the conveying direction of a sheet bundle T or a portion of each rotating plate that is positioned at the middle portion in the conveying direction of a sheet bundle T. In more detail, the portion of the rotating plate 513, which is positioned on the upstream side in the conveying direction of a sheet bundle T, is formed so as to hang down toward the lower side in a vertical direction. Furthermore, as shown in FIG. 2, the end portion of the rotating plate 513, which is positioned on the upstream side in the conveying direction of a sheet bundle T, is positioned below the opening 69 in the vertical direction. Accordingly, a configuration where a sheet bundle T placed on the rotating plate 513 does not easily return to the sheet stacking unit 35 is achieved in the binding device 500 of this exemplary embodiment.

<Description of Stacking of a Sheet Bundle onto Sheet Bundle Stacking Unit>

After a sheet bundle T is conveyed to the rotating plates 513 by the ejection roller 39, the first and second binding units 510 and 520 are further moved in the direction where the first and second binding units 510 and 520 are separated from each other in the binding device 500 of this exemplary embodiment. When the first and second binding units 510 and 520 are further moved, the support of a sheet bundle T performed by the rotating plates 513 is released. Accordingly, the ejection roller 39 conveys a sheet bundle T toward the downstream side on the conveying path D, so that the sheet bundle T falls from the open portion that is formed at the lower portion of the device frame 530 (see FIG. 2). Then, the sheet bundle T is stacked on the sheet bundle stacking unit 70 that is disposed on the lower side.

In the binding device 500 of this exemplary embodiment, the edges 513C (see FIG. 5B) are formed at the rotating plates 513, respectively. Further, as shown in FIG. 5B, the edges 513C are inclined with respect to the lower frames 512 toward the main body frame 36, respectively. For this reason, a gap formed between the rotating plates 513 of the first and second binding units 510 and 520 is increased toward the main body frame 36 in the state of FIG. 5B. That is, a gap formed between the rotating plates 513 of the first and second binding units 510 and 520 is increased toward the rear end portion of a sheet bundle T that is placed on the rotating plates 513.

Furthermore, in the binding device 500 of this exemplary embodiment, the gap between the rotating plates 513 of the first and second binding units 510 and 520 becomes a minimum at a position where the apex 513B (see FIG. 5B) of each rotating plate 513 is set. Moreover, the gap between the rotating plates 513 is gradually increased toward the main body frame 36 from the position where the apex 513B of each rotating plate 513 is set. For this reason, when a sheet bundle T falls down due to the movement of the first and second binding units 510 and 520 in the direction where the first and second binding units 510 and 520 are separated from each other, the sheet bundle T falls so that the rear end portion of the sheet bundle T falls first. That is, the rear end portion of the sheet bundle T reaches the sheet bundle stacking unit 70 prior to the front end portion thereof, and the front end portion thereof then reaches the sheet bundle stacking unit 70.

Further, as the number of sheet bundles T stacked on the sheet bundle stacking unit 70 is increased, the sheet bundle stacking unit 70 is moved down. Although not described above, first and second sensors S1 and S2 for detecting a sheet bundle T placed on the sheet bundle stacking unit 70 are provided at the lower frames 512 as shown in FIG. 2. Furthermore, while a sheet bundle T is detected by any one of the first and second sensors S1 and S2, an operation for moving down the sheet bundle stacking unit 70 is continued. However, while the first and second sensors S1 and S2 do not detect a sheet bundle T, the sheet bundle stacking unit 70 is set to be stopped. Accordingly, the interference between a sheet bundle T stacked on the sheet bundle stacking unit 70 and the rotating plates 513 is avoided. Moreover, when binding processing is performed by the stapler 40, the positioning of a sheet bundle T above the opening 69 formed at the main body frame 36 is suppressed.

Each of the first and second sensors S1 and S2 is a transmission sensor, and includes a light emitting part (not shown) mounted on the lower frame 512 of the first binding unit 510 and a light receiving part (not shown) mounted on the lower frame 512 of the second binding unit 520. That is, the light emitting part of each of the first and second sensors S1 and S2 is provided at the lower frame 512 of the first binding unit 510, and the light receiving part of each of the first and second sensors S1 and S2 is provided at the lower frame 512 of the second binding unit 520.

Figure 14B:
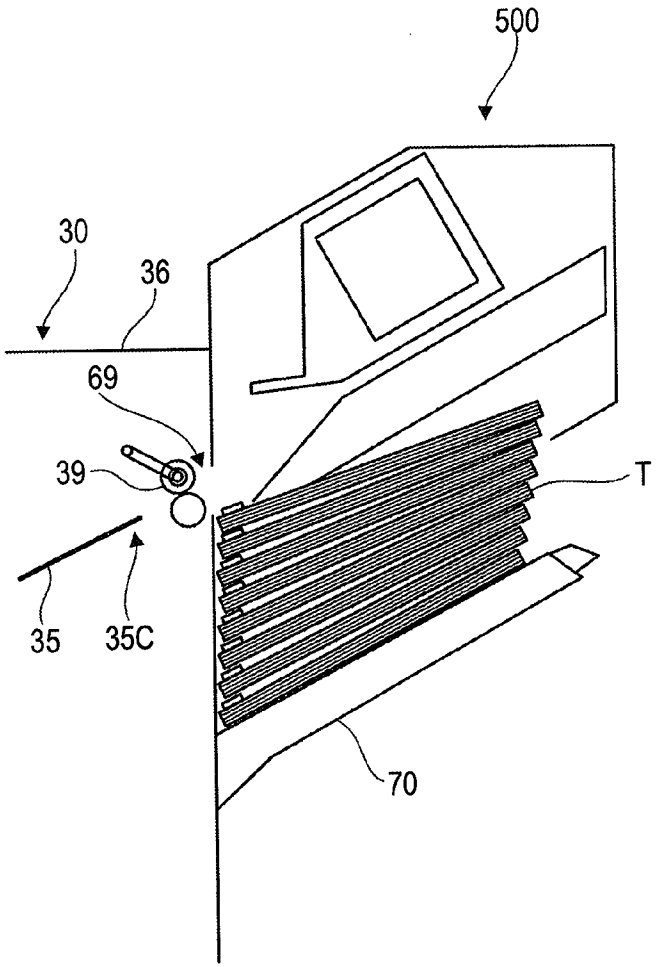
FIGS. 14A and 14B are views showing a state where sheet bundles are stacked.
Figure 14A:
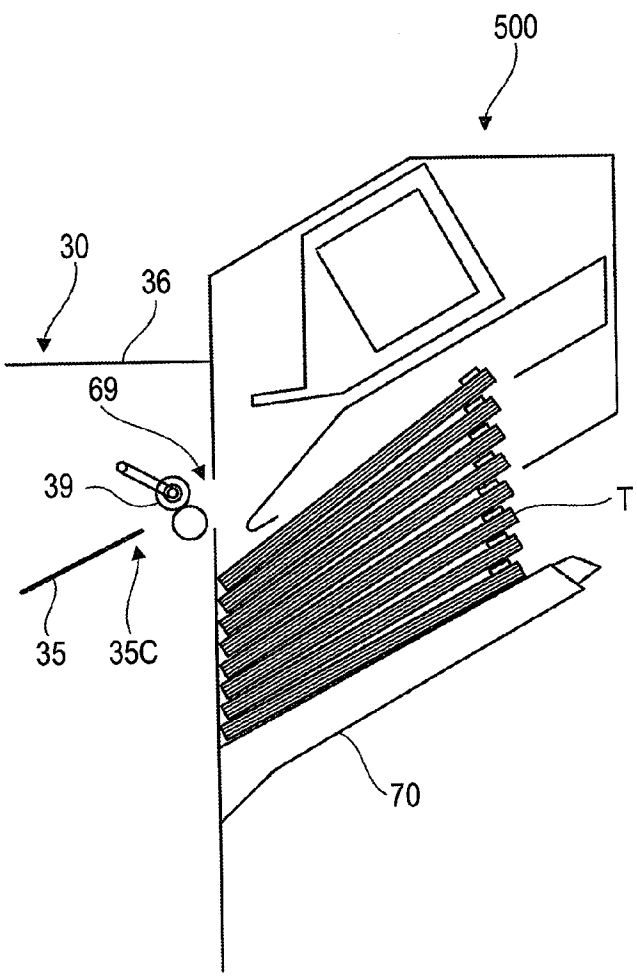

Here, when binding processing is performed on a sheet bundle T, a convex portion is formed at the front or rear end portion of a sheet bundle T by a staple of the stapler 40, a tongue portion 522 (see FIGS. 16A to 16C to be described below) formed by the binding device 500, or the like. Further, as sheet bundles T having the convex portions are stacked on the sheet bundle stacking unit 70, the bulk (stacking height) of the sheet bundles T varies on the front and rear end sides of a sheet bundle T as shown in FIGS. 14A and 14B (a view showing a state where sheet bundles are stacked). Meanwhile, FIG. 14A shows a state where sheet bundles T of which the front end portions are bound are stacked, and FIG. 14B shows a state where sheet bundles T of which the rear end portions are bound are stacked.

Meanwhile, it may be possible to detect a sheet bundle T stacked on the sheet bundle stacking unit 70 by not both the first and second sensors S1 and S2 but, for example, only the first sensor S1. However, in this case, there is a concern that the down movement of the sheet bundle stacking unit 70 is stopped even though the bulk of the front end portions of sheet bundles T is large. That is, there is a concern that the down movement of the sheet bundle stacking unit 70 is stopped even though the front end portion of a sheet bundle T interferes with the rotating plates 513. Further, it may be possible to detect a sheet bundle T stacked on the sheet bundle stacking unit 70 by, for example, only the second sensor S2. However, in this case, there is a concern that the down movement of the sheet bundle stacking unit 70 is stopped even though the bulk of the rear end portions of sheet bundles T is large. That is, there is a concern that the down movement of the sheet bundle stacking unit 70 is stopped even though the rear end portion of a sheet bundle T interferes with the rotating plates 513. For this reason, in this exemplary embodiment, two sensors, that is, the first sensor S1 for detecting the rear end portion of a sheet bundle T and the second sensor S2 for detecting the front end portion of a sheet bundle T are provided, and the sheet bundle stacking unit 70 is adapted to stop when a sheet bundle T is not detected by the first and second sensors S1 and S2.

<Description of Binding Section>

Next, the binding section 511C (see FIG. 2) of each of the upper frames 511 of the respective first and second binding units 510 and 520 will be described. FIGS. 15A and 15B and FIGS. 16A to 16C are views showing the binding section 511C of the upper frame 511. Meanwhile, FIGS. 15A and 15B and FIGS. 16A to 16C also show a part of the lower frame 512 of each of the first and second binding units 510 and 520.

Figure 15A:
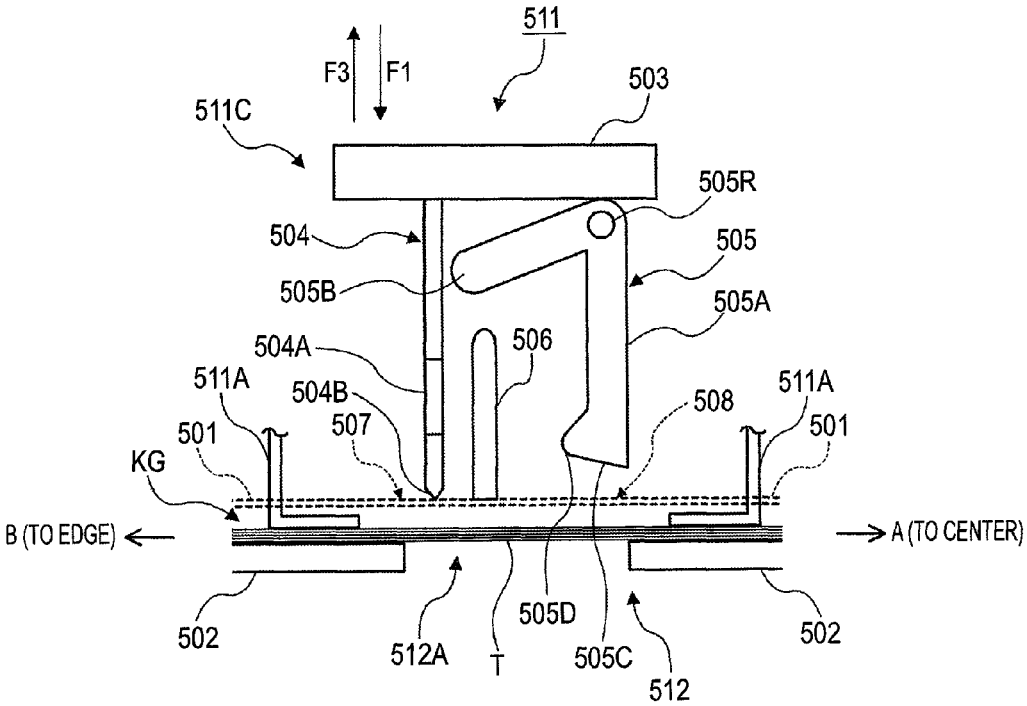
FIGS. 15A and 15B are views showing a binding section that is provided on an upper frame.

As shown in FIG. 15A, a movable part 503 is disposed in the binding section 511C serving as an example of a binding section provided in the upper frame 511 of each of the first and second binding units 510 and 520. The movable part 503 is adapted to reciprocate in the normal direction (the directions F1 and F3) of a base 501 that forms a frame body of the upper frame 511 facing the lower frame 512. Further, a blade 504 serving as an example of a linear cutting part and the punching member 505 serving as an example of a tongue-like cutting part are provided on the side of the movable part 503 facing the lower frame 512.

Further, the base 501 of the upper frame 511 is disposed parallel to a bottom member 502 that forms a frame body of the lower frame 512 facing the upper frame 511. Furthermore, a protruding portion 506, an opening portion 507, and an opening portion 508 are formed at the base 501 at a position that corresponds to the hole portion 512A (see FIG. 2) formed at the bottom member 502 of the lower frame 512. The protruding portion 506 is formed so as to protrude toward the movable part 503. The blade 504 of the movable part 503 passes through the opening portion 507. The punching member 505 of the movable part 503 passes through the opening portion 508.

Figure 16A:
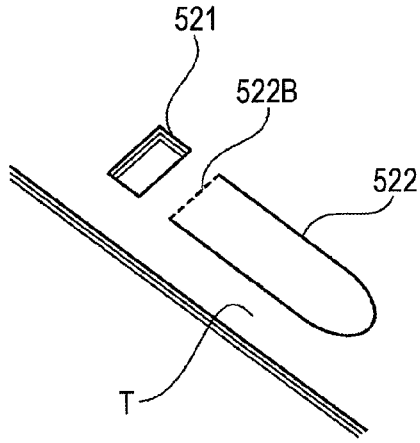
FIGS. 16A to 16C are views showing the binding section that is provided on an upper frame.

The blade 504 provided on the movable part 503 is formed of a rectangular plate-like member that includes a sharp end portion 504B at one end thereof. The blade 504 forms a slit-like (linear) cut portion at a sheet bundle T. That is, when the movable part 503 is moved toward the base 501, the blade 504 cuts the sheet bundle T in the shape of a slit as shown in FIG. 16A. Accordingly, the blade 504 forms a slit opening 521 that is a slit-like cut.

Further, the punching member 505 provided on the movable part 503 forms a tongue portion 522, which serves as an example of a cut-out piece (deformed portion) formed of a tongue-like cut portion, by cutting a sheet bundle T in the shape of a tongue.

Figure 15B:
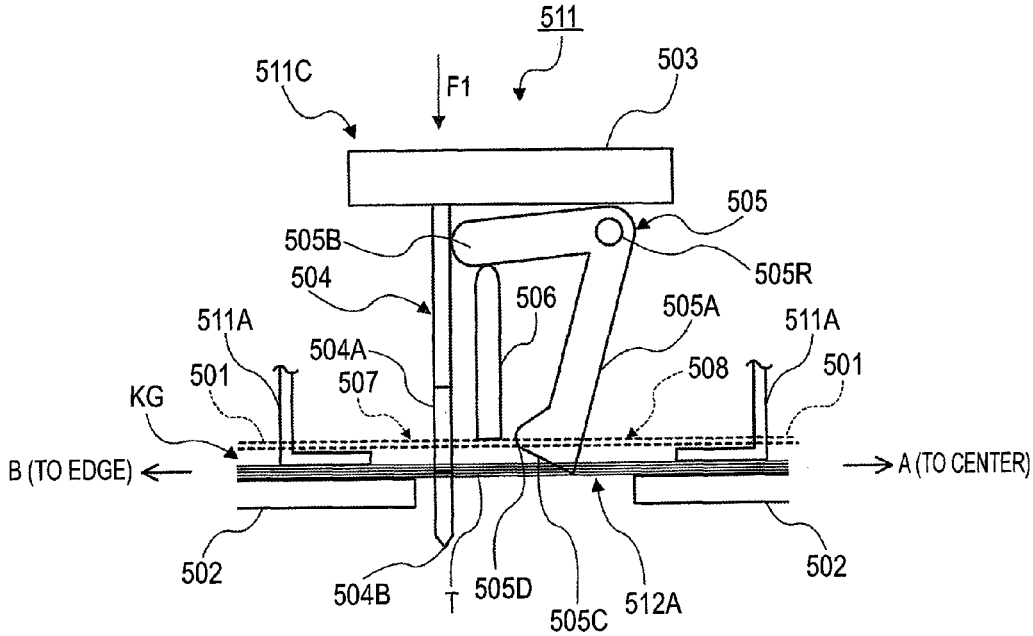

As shown in FIG. 15A, the punching member 505 is a substantially L-shaped member having a bent portion and is adapted to be swung about a rotating shaft 505R as a center. That is, a main part 505A is formed at one side of the punching member 505 that is formed into a substantially L shape, and a subsidiary part 505B is formed at the other side thereof. Further, when the movable part 503 is moved toward the base 501, the protruding portion 506 disposed on the base 501 pushes up the subsidiary part 505B as shown in FIG. 15B. As the protruding portion 506 pushes up the subsidiary part 505B, the main part 505A is swung about the rotating shaft 505R as a center so as to be inclined toward the blade 504.

Furthermore, a sharp blade portion 505C is formed at a portion of the main part 505A opposite to the rotating shaft 505R, that is, at the edge of an end portion of the main part 505A facing the base 501. Accordingly, the main part 505A is swung so as to be inclined toward the blade 504 as shown in FIG. 15B, so that the end portion of the main part 505A facing the base 501 presses a sheet bundle T in the thickness direction of a sheet bundle. As a result, the tongue portion 522, which is a tongue-like cut portion, is formed at the sheet bundle T. However, a blade portion 505C is not formed at an edge portion, which is positioned close to the blade 504, of the edge of an end portion of the main part 505A facing the base 501. For this reason, as shown in FIG. 16A, a cut portion is not formed at the sheet bundle T at an end portion 522B of the tongue portion 522 facing the blade 504 and the tongue portion 522 is formed as a cut portion that is connected to the sheet bundle T at the end portion 522B of the tongue portion positioned close to the blade 504.

Meanwhile, when the subsidiary part 505B is not pushed up by the protruding portion 506, the main part 505A is set to be substantially perpendicular to the lower frame 512. Further, a protrusion 505D, which protrudes toward the blade 504, is formed at the side portion of the main part 505A, specifically, at the side portion of the main part 505A facing the blade 504.

While a sheet bundle T is pressed by the lower surface of the moving frame 511A and the upper surface of the bottom member 502 (the upper surface of the lower frame 512) as described above, the main part 505A shown in FIG. 15B is swung so as to be inclined toward the blade 504. Accordingly, a gap (floatation) between sheets S is not easily formed in a sheet bundle T, so that a portion, which is apt to loosen, is hardly formed at a sheet bundle T on which binding processing has been performed. Therefore, the entire sheet bundle T is bound as one body, so that the loosening of the sheet bundle T is suppressed. In addition, even though the number of sheets S of a sheet bundle T is large, the sheet bundle T is hardly loosened. Further, since floatation does not exist in a sheet bundle T, the sheet bundle T is hardly loosened in the width direction of the sheet bundle T (the direction A (see FIG. 4B) orthogonal to the conveying path D of the sheet bundle T). Accordingly, deviation (misalignment) between sheets S is also suppressed at the end portions of the sheet bundle T in the width direction.

Figure 16B:
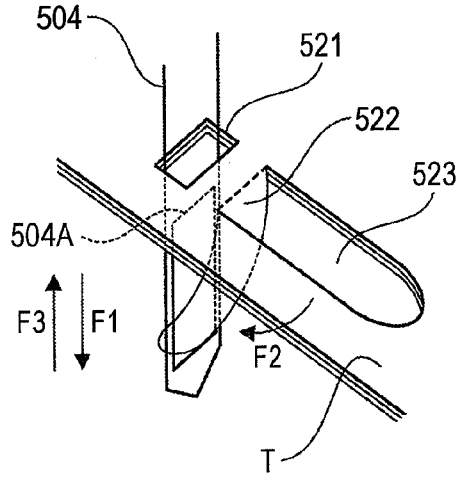

When the subsidiary part 505B of the punching member 505 is further pushed up after the blade portion 505C of the main part 505A forms the tongue portion 522 at the sheet bundle T, the main part 505A is swung so as to be inclined toward the blade 504. Accordingly, the main part 505A bends the tongue portion 522 toward the slit opening 521 (the direction F2) as shown in FIG. 16B. As a result, the protrusion 505D of the main part 505A inserts the tongue portion 522 into an eyelet hole 504A that is an opening formed at the blade 504 having passed through the slit opening 521. That is, the main part 505A bends the tongue portion 522, which is cut by the main part, toward the slit opening 521, and inserts the tongue portion 522 into the eyelet hole 504A of the blade 504 that has passed through the slit opening 521.

Figure 16C:
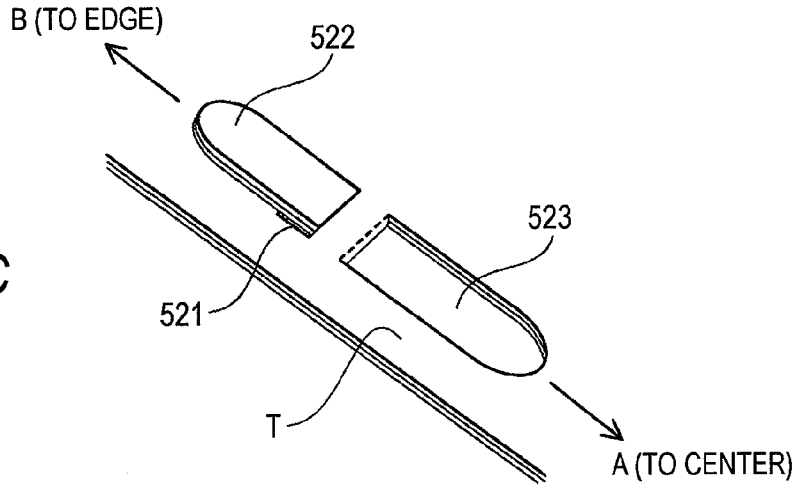

Accordingly, when the blade 504 is pulled up from the slit opening 521, the tongue portion 522 is inserted into the slit opening 521 as shown in FIG. 16C.

<Description of Operation of Binding Section>

Subsequently, the operation of the binding section 511C will be described in detail.

When binding processing starts to be performed in each of the first and second binding units 510 and 520, the movable part 503 is moved toward the base 501 by a cam driven by a motor (not shown) in the binding section 511C while a sheet bundle T is pressed by the lower surface of the moving frame 511A and the upper surface of the bottom member 502 (the upper surface of the lower frame 512). Further, the blade 504, which is provided on the side of the movable part 503 facing the base 501 (the lower frame 512), reaches a sheet bundle T. Then, the blade 504 presses the sheet bundle T, so that a front end portion 504B of the blade 504 passes through the sheet bundle T. Accordingly, the binding section 511C forms a slit opening 521, which is a slit-like cut portion shown in FIG. 16A, at a sheet bundle T.

Moreover, the movable part 503 is moved so as to approach the base 501, so that the protruding portion 506 formed at the base 501 pushes up the subsidiary part 505B of the punching member 505. As the protruding portion 506 pushes up the subsidiary part 505B, the main part 505A of the punching member 505 is swung about the rotating shaft 505R as a center so as to be inclined toward the blade 504. Accordingly, the blade portion 505C of the main part 505A presses a sheet bundle T, so that the blade portion 505C passes through the sheet bundle T. Therefore, the binding section 511C forms the tongue portion 522, which is shown in FIG. 16A, of which the end portion 522B positioned close to the blade 504 is connected to the sheet bundle T, at the sheet bundle T.

In this case, a region where the lower surface of the moving frame 511A and the upper surface of the lower frame 512 press a sheet bundle T is set so as to surround the blade 504 and the punching member 505 of the binding section 511C. Accordingly, the floatation of a sheet bundle T is more reliably suppressed.

Subsequently, when the movable part 503 is further moved toward the base 501, the main part 505A of the punching member 505 is further inclined toward the blade 504. Accordingly, as shown in FIG. 16B, the protrusion 505D of the punching member 505 presses the cut tongue portion 522 toward the blade 504 and inserts the tongue portion 522 into the eyelet hole 504A of the blade 504 (in the direction of an arrow F2 in FIG. 16B). Meanwhile, the punching member 505 is not shown in FIG. 16B.

After that, while a sheet bundle T is pressed by the lower surface of the moving frame 511A and the upper surface of the bottom member 502 (the upper surface of the lower frame 512), the movable part 503 is moved in a direction where the movable part 503 is separated from the lower frame 512, that is, the movable part 503 is moved up in the direction of an arrow F3 of FIG. 15A. In this case, the tongue portion 522 is moved up while being caught by the eyelet hole 504A of the blade 504. Accordingly, the tongue portion 522 is inserted into the slit opening 521 as shown in FIG. 16C. In this way, the tongue portion 522 inserted into the slit opening 521 is wound on the entire sheet bundle T. Accordingly, the sheet bundle T is bound by the tongue portion 522.

As described above, the tongue portion 522 is wound on the entire sheet bundle T while a sheet bundle T is pressed by the lower surface of the moving frame 511A and the upper surface of the bottom member 502 (the upper surface of the lower frame 512). Accordingly, a gap (floatation) between sheets S is hardly formed in a sheet bundle T, so that a portion, which is apt to loosen, is hardly formed at a sheet bundle T on which binding processing has been performed.

Further, a binding hole 523 is formed at a position where the tongue portion 522 is punched on a sheet bundle T on which binding processing has been completed (see FIG. 16C). The binding hole 523 may be used as an opening into which a binding tool provided at a file, a binder, or the like is inserted.

<Description of Movement Patterns of First and Second Binding Units>

Meanwhile, this exemplary embodiment employs a configuration where the first and second binding units 510 and 520 are disposed on both sides of a recording medium stacking member (the sheet stacking unit 35 and the rotating plates 513) in the direction A (see FIG. 4B) orthogonal to the conveying path D of a sheet bundle T and are moved toward the middle portion of the recording medium stacking member in the direction A when binding processing is performed. Accordingly, the time taken for the first and second binding units to reach a binding position or time taken for the first and second binding units to retract from the binding position is reduced through the reduction of the moving distances (strokes) of the first and second binding units 510 and 520, so that the time required for the binding processing is reduced. In particular, in the first and second binding units 510 and 520 that perform binding processing by deforming a sheet bundle T in the thickness direction, the punching member 505 and the like operates in a complex manner as described above. Accordingly, time required for the binding processing, which is performed by the first and second binding units, is longer than that required for the binding processing performed using staples by the stapler 40. Therefore, the time taken for the first and second binding units to reach a binding position or the time taken for the first and second binding units to retract from the binding position is reduced through the reduction of the strokes of the first and second binding units 510 and 520, so that the time required for the binding processing is reduced. As a result, the time, which is required for post-processing in the sheet processing apparatus 3 when binding processing is performed, is reduced.

Further, for example, when the respective first and second binding units 510 and 520 perform binding processing at two positions of the middle portion of a sheet bundle T and two positions closer to the end portions of the sheet bundle than the middle portion, that is, at a total of four positions, the first and second binding units 510 and 520 are moved to binding positions close to the middle portion of the sheet bundle T. Furthermore, the first and second binding units perform binding processing at the binding positions close to the middle portion. Then, the first and second binding units are moved from the binding positions, which are close to the middle portion, to binding positions that are closer to the end portions of the sheet bundle than the binding positions close to the middle portion, and perform binding processing at the binding positions close to the end portions. That is, when performing binding processing at plural binding positions, the respective first and second binding units 510 and 520 sequentially perform binding processing at the binding positions close to the middle portion and the binding positions close to the end portions in this order.

As described above, the respective first and second binding units 510 and 520 bind a middle portion of a sheet bundle T while pressing the middle portion of the sheet bundle T first by the lower surface of the moving frame 511A and the upper surface of the bottom member 502 (the upper surface of the lower frame 512). Then, the respective first and second binding units 510 and 520 bind the end portions (both end portions) of the sheet bundle T while pressing the end portions of the sheet bundle T similarly. For this reason, since a gap (floatation) between sheets S is hardly formed over the entire sheet bundle T in the width direction (the direction A (see FIG. 4B) orthogonal to the conveying path D of a sheet bundle T), looseness is particularly suppressed over the entire sheet bundle T in the width direction. Accordingly, deviation (misalignment) between sheets S is further suppressed at the end portions of the sheet bundle T in the width direction (at the side portion of the sheet bundle T).

<Description of Positional Relationship Among Binding Section, Sheet Reference Member, Moving Frame>

Here, a positional relationship among the binding section 511C, the sheet reference member 511B, and the moving frame 511A will be described.

Figure 17A:
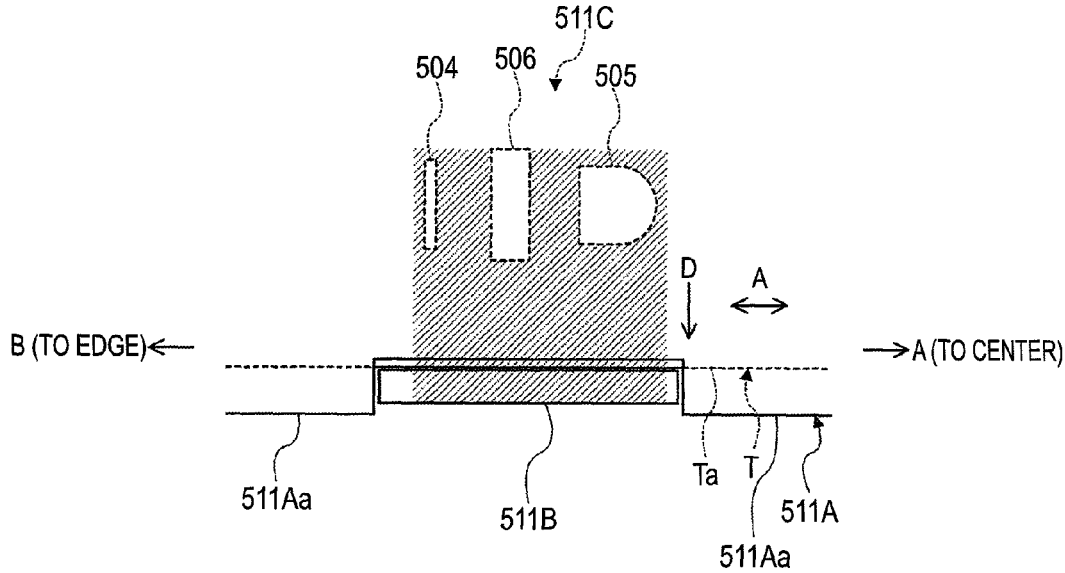
FIGS. 17A and 17B are views illustrating a positional relationship among the binding section, a sheet reference member, and a moving frame.
Figure 17B:
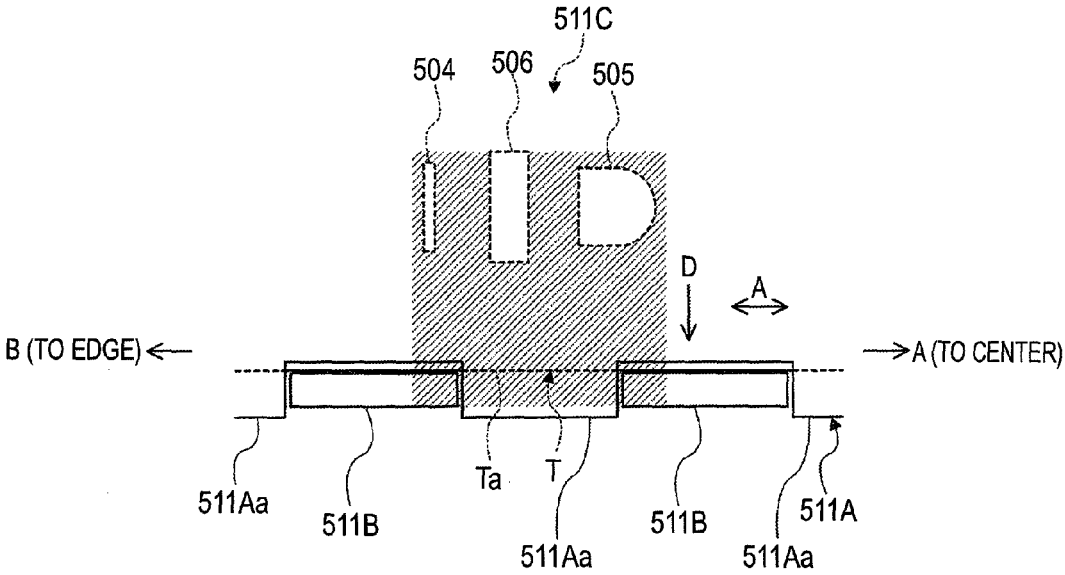

FIGS. 17A and 17B are views illustrating a positional relationship among the binding section 511C, the sheet reference member 511B, and the moving frame 511A. FIGS. 17A and 17B are views seen from the upper side of an operation direction of the binding section 511C (the upper side of a sheet bundle T). FIG. 17A shows a configuration where one sheet reference member 511B is provided in each of the first and second binding units 510 and 520, and FIG. 17B shows a configuration where plural (here, two) sheet reference members 511B are provided in each of the first and second binding units.

As shown in FIGS. 17A and 17B, the sheet reference member 511B may be disposed so as to overlap a width region (hatched regions in FIGS. 17A and 17B) where the binding section 511C is disposed in the width direction of a sheet bundle T (the direction A orthogonal to the conveying path D of a sheet bundle T). That is, the sheet reference member 511B may be disposed so as to overlap the whole or a part of a width region where the binding section 511C is disposed in the width direction of a sheet bundle T.

Accordingly, the binding section 511C binds a sheet bundle T at a position where a front end portion Ta of the sheet bundle T to be bound is aligned by the sheet reference member 511B. Therefore, after being aligned, a front end portion Ta of a sheet bundle T is bound at least at a position where the binding section 511C binds a sheet bundle T. For this reason, even though sheets S are not aligned between binding positions (between the sheet reference members 511B of the respective first and second binding units 510 and 520) when binding processing is performed, the front end portion Ta of the sheet bundle T is aligned at the binding position. Accordingly, after binding processing is performed, misalignment of sheets S between binding positions is also corrected so as to correspond to the alignment at the binding position.

Further, downstream end portions 511Aa of the moving frame 511A in the direction of the conveying path D of a sheet bundle T may be positioned on the downstream side of the sheet reference member 511B in the direction of the conveying path D as shown in FIGS. 17A and 17B. Even though plural sheet reference members 511B are provided in each of the first and second binding units 510 and 520 as shown in FIG. 17B, the downstream end portions 511Aa of the moving frame 511A, which is positioned between two sheet reference members 511B, in the direction of the conveying path D may be positioned on the downstream side of the sheet reference members 511B in the direction of the conveying path D.

Accordingly, when the moving frame 511A is moved toward the lower frame 512 and a sheet bundle T is interposed between the lower surface of the moving frame 511A and the upper surface of the lower frame 512 so that floatation of the sheet bundle T is pressed (see FIG. 10B), the extrusion of the sheet bundle T to the downstream side in the direction of the conveying path D is suppressed near the sheet reference members 511B. That is, when the moving frame 511A presses a sheet bundle T toward the lower frame 512, floating portions of the sheet bundle T cannot be moved in any direction and are extruded near the sheet reference members 511B to the downstream side in the direction of the conveying path D. Meanwhile, since the lower surface of the moving frame 511A extends near the sheet reference members 511B up to the downstream side of the sheet reference members 511B in the direction of the conveying path D, the lower surface of the moving frame 511A presses the sheet bundle T near the sheet reference members 511B up to the downstream side in the direction of the conveying path D. Accordingly, a space where the sheet bundle T is extruded is closed. Therefore, it is suppressed that the sheet bundle T is interposed between the lower surface of the moving frame 511A and the upper surface of the lower frame 512 while being scattered to the downstream side of the sheet reference member 511B in the direction of the conveying path D. As a result, the generation of fold lines on the sheet bundle T is suppressed.

<Description of Another Configuration of Sheet Reference Member>

In each of the first and second binding units 510 and 520 of this exemplary embodiment, the sheet reference member 511B has been adapted to approach and separate from the upper surface of the lower frame 512. A configuration where the sheet reference member 511B is fixed to the upper surface of the lower frame 512 may be employed other than this configuration.

Figure 18:
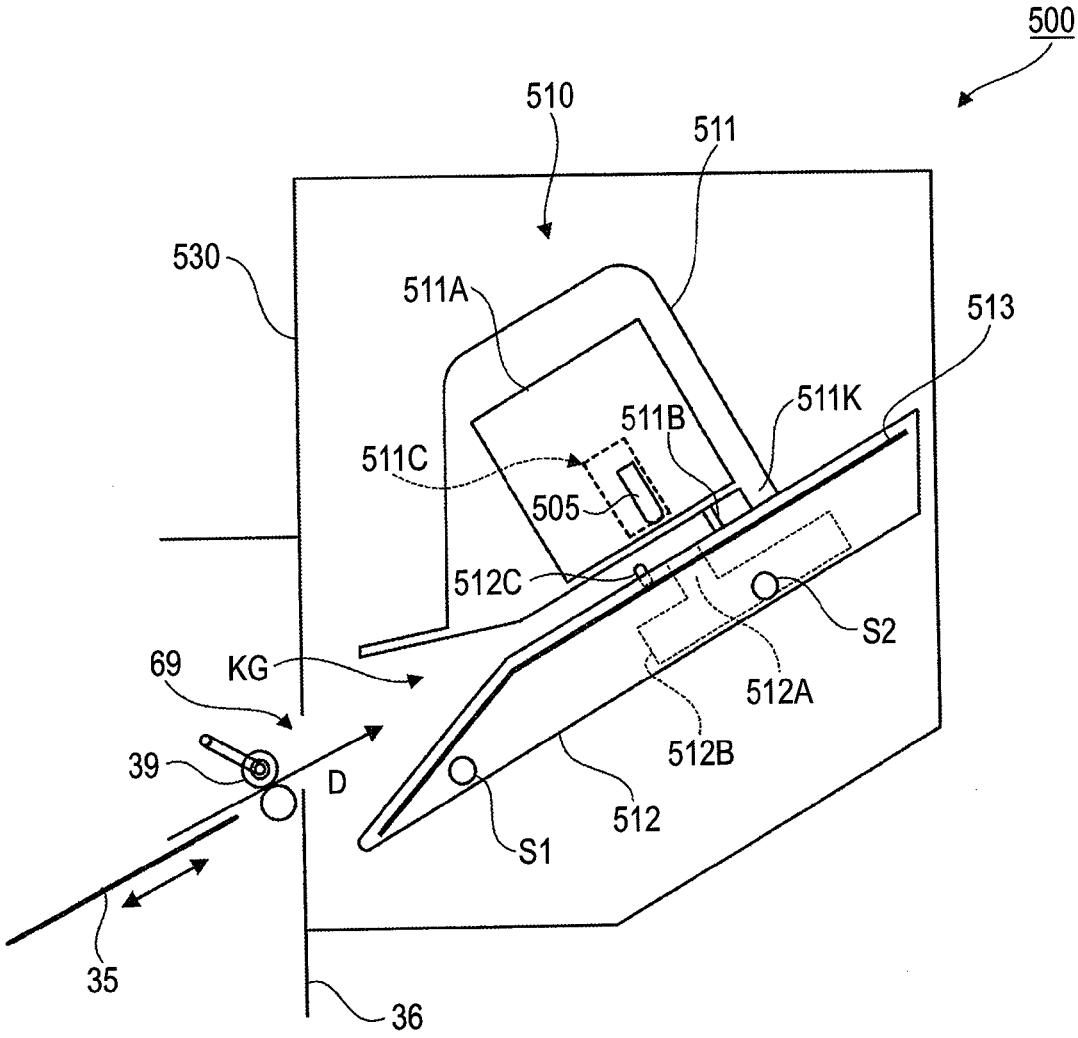
FIG. 18 is a view showing a first binding unit that includes a sheet reference member fixed to the upper surface of a lower frame.

FIG. 18 is a view showing a first binding unit 510 that includes a sheet reference member 511B fixed to the upper surface of the lower frame 512. As shown in FIG. 18, a sheet reference member 511B may be fixed to the upper surface of a lower frame 512 and a front end portion of a sheet bundle T may be pressed against the side surface of the sheet reference member 511B by the rotation of the ejection roller 39. This is the same in the case of a second binding unit 520.

Even in this configuration, the sheet reference member 511B is set to a position that is separated from the front end portion of a sheet bundle T in the direction of the conveying path D (see FIG. 4B) of the sheet bundle T. That is, the sheet reference members 511B of the first and second binding units 510 and 520 are set to positions existing on the downstream side of the front end portion of a sheet bundle T, which is set to a predetermined position existing on the upstream side of a binding position on the conveying path D, on the conveying path D. Accordingly, when the respective first and second binding units 510 and 520 are moved in the direction A (see FIG. 4B) orthogonal to the conveying path D of a sheet bundle T, the sheet reference members 511B suppress the deviation of the position of the sheet bundle T or the misalignment of the sheet bundle T.

However, if the configuration where the above-mentioned sheet reference member 511B approaches and separates from the upper surface of the lower frame 512 is employed, it may be possible to immediately convey a sheet bundle T to the downstream side on the conveying path D by the ejection roller 39 by making the sheet reference member 511B retract to a position that is separated from the upper surface of the lower frame 512. For this reason, it may be possible to start to convey a sheet bundle T by the ejection roller 39 before the first and second binding units 510 and 520 start to move in the direction where the first and second binding units 510 and 520 are separated from each other (the direction orthogonal to the conveying path D) or at the same time with the start of the movement of the first and second binding units. Accordingly, it may be possible to more quickly start to convey a sheet bundle T to the open portion that is formed at the lower portion of the device frame 530 (see FIG. 2). As a result, the time which is required until a sheet bundle T is stacked on the sheet bundle stacking unit 70 from the completion of binding processing is reduced. For this reason, the time which is required for post-processing in the sheet processing apparatus 3 during the binding processing is reduced.

<Description of Another Configuration of Binding Section>

Meanwhile, the binding section 511C of each of the above-mentioned first and second binding units 510 and 520 has been adapted to perform binding processing by inserting the tongue portion 522 into the slit opening 521. Other than this configuration, a method, which presses the respective sheets S of a sheet bundle T against each other, may be used as a binding mechanism for deforming a sheet bundle T, which is used in each of the first and second binding units 510 and 520, in the thickness direction.

Figure 19A:
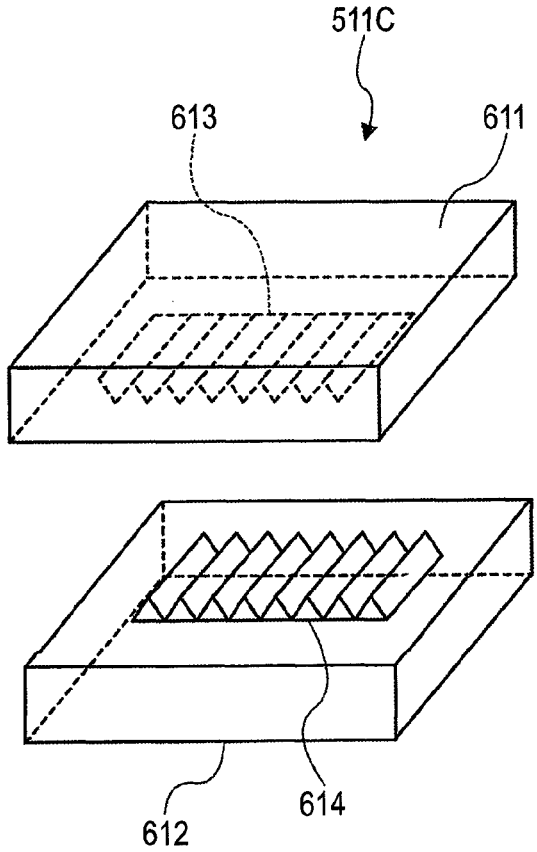
FIGS. 19A and 19B are views illustrating a binding section that performs binding processing by pressing sheets against each other.
Figure 19B:
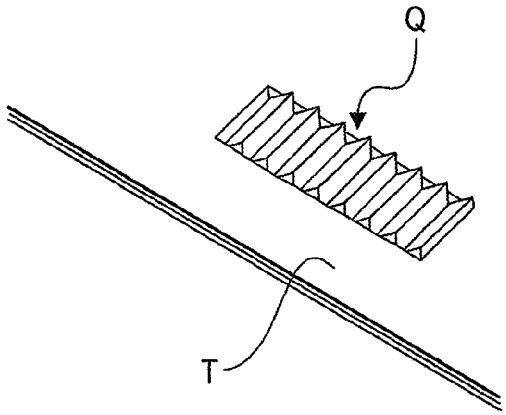

FIGS. 19A and 19B are views illustrating a binding section 511C that performs binding processing by pressing sheets S against each other. FIG. 19A is a perspective view showing upper and lower press frames 611 and 612 for pressing sheets S, which are disposed in the binding section 511C, against each other. FIG. 19B is a view showing a sheet bundle T that has been bound by pressing the sheets S against each other. Meanwhile, components of the upper and lower frames 511 and 512 are not shown in FIG. 19A.

As shown in FIG. 19A, an upper surface-press tooth portion 613, which is formed of concavo-convex press teeth for pressing the upper surface of a sheet bundle T, is formed on the lower surface of the upper press frame 611. Further, a lower surface-press tooth portion 614, which is formed of concavo-convex press teeth for pressing the lower surface of a sheet bundle T, is formed in a region, which faces the upper surface-press tooth portion 613, on the upper surface of the lower press frame 612 so as to mesh with the upper surface-press tooth portion 613.

When a sheet bundle T is pressed by the upper and lower press frames 611 and 612 in this configuration, the upper surface-press tooth portion 613 meshes with the lower surface-press tooth portion 614. As a result, as shown in FIG. 19B, there is formed a concavo-convex deformed portion Q in a thickness direction that serves as an example of a deformed portion of the sheet bundle T. Fibers of sheets S are entangled between adjacent sheets S at the concavo-convex deformed portion Q of the sheet bundle T in the thickness direction. As a result, the sheet bundle T formed of plural sheets S is bound.

<Description of Another Configuration of First and Second Binding Units>

Further, the first and second binding units 510 and 520, which have been described above, may have the following configuration.

Figure 20:
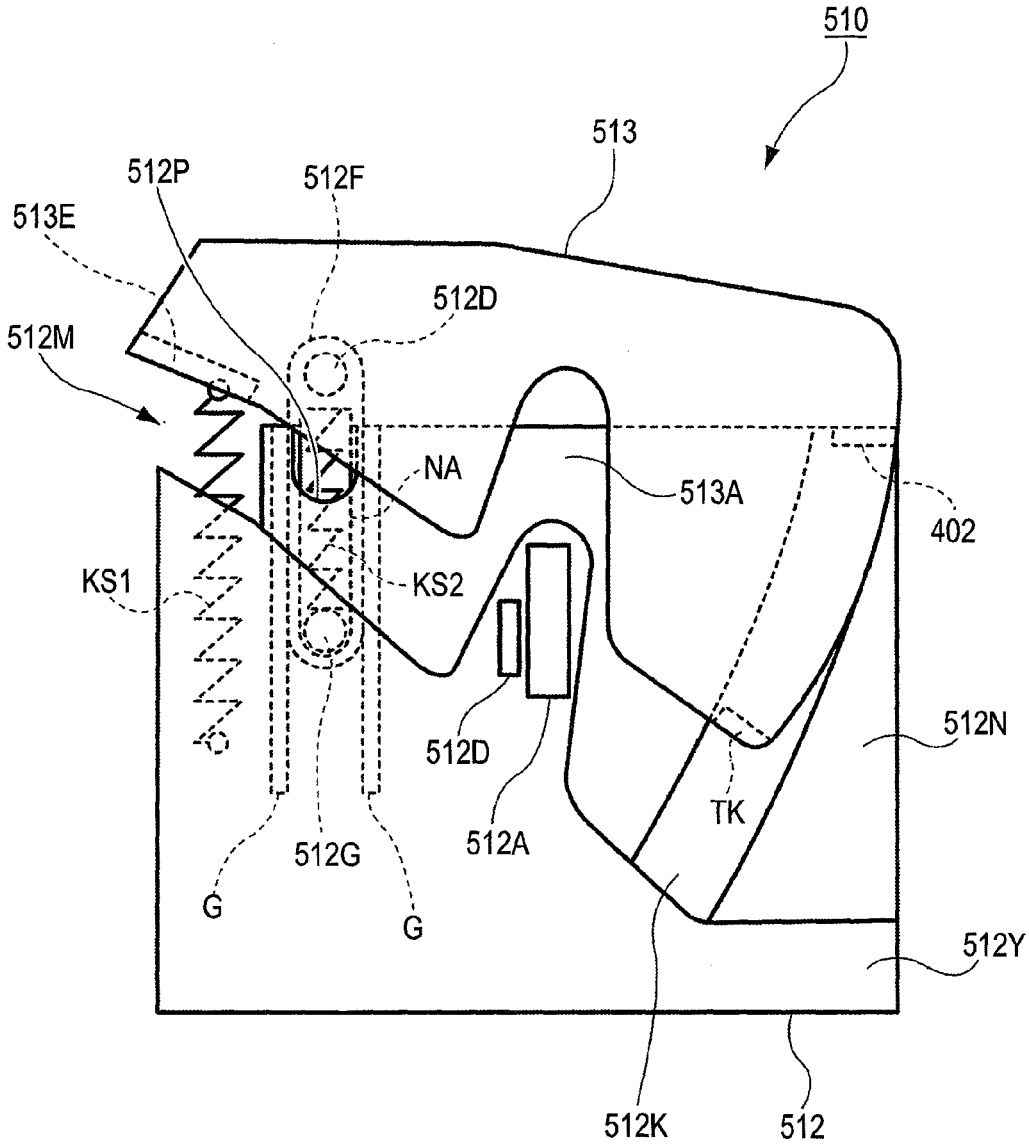
FIG. 20 is a view illustrating another embodiment of the first and second binding units.

FIG. 20 is a view illustrating another embodiment of the first and second binding units 510 and 520. Meanwhile, since the first and second binding units 510 and 520 have the same configuration as described above, the first binding unit 510 will be mainly described. Further, an upper frame 511 is not shown in FIG. 20. Furthermore, FIG. 20 shows a first binding unit 510 as the first binding unit is seen from above. Moreover, components having the same functions as described above will be denoted by the same reference numerals and the description thereof will be omitted.

In this exemplary embodiment, the first binding unit 510 is adapted so that an upper surface 512Y of a lower frame 512 and an upper surface of a rotating plate 513 have the same height in a height direction. In more detail, a stepped portion is formed on the upper surface of the lower frame 512, and a support surface 512N, which is positioned below the upper surface 512Y and supports the rotating plate 513 from below, is formed on the lower frame 512. Further, in this exemplary embodiment, the rotating plate 513 is placed on the support surface 512N. Furthermore, in this exemplary embodiment, the thickness of the rotating plate 513 is set so that the upper surface 512Y and the upper surface of the rotating plate 513 have the same height. Here, in the case of the configuration of this exemplary embodiment, a sheet bundle T enters the gap KG (see FIG. 2) more smoothly when the first and second binding units 510 and 520 approach each other.

Meanwhile, a groove 512K, which guides a protrusion TK formed on the lower surface of the rotating plate 513, is formed on the support surface 512N. Further, in this exemplary embodiment, a second regulating part 402 for regulating the rotation of the rotating plate 513 is formed in the groove 512K. Furthermore, in this exemplary embodiment, a protruding portion 513E protrudes downward from the lower surface of the rotating plate 513, and an end portion of a first coil spring KS1 is mounted on the protruding portion 513E. Moreover, in this exemplary embodiment, a notch 512M for the avoidance of interference between the protruding portion 513E and the lower frame 512 is formed at the lower frame 512. Further, a notch 512P for the avoidance of interference between a shaft 512D and the lower frame 512 is formed at the lower frame 512.

As described above, in the sheet processing apparatus 3 of this exemplary embodiment, a sheet bundle T is stopped on the front side of a position where binding processing is performed (on the upstream side of a position, where binding processing is performed, on the conveying path D), and the front end portion of the stopped sheet bundle T bumps against the side surface of the sheet reference member 511B and is pressed in the lateral direction (the direction F4) of the sheet reference member 511B by the rotation of the ejection roller 39. Accordingly, the entire front end portion of the sheet bundle T to be bound is aligned. Further, in this case, the sheet reference member 511B provided in the first binding unit 510 is disposed at a position where a sheet bundle T is not interposed (not pressed) between the sheet reference member 511B and the lower frame 512. Therefore, a sheet bundle T is smoothly moved toward the sheet reference member 511B by the ejection roller 39, so that alignment for aligning the front end portion of a sheet bundle T with high accuracy is performed. In addition, if an operation for pressing a sheet bundle T against the side surface of the sheet reference member 511B is repeated several times by the rotation of the ejection roller 39 in the normal and reverse directions, the entire sheet bundle T is aligned with higher accuracy.

The foregoing description of the exemplary embodiments of the invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium post-processing apparatus comprising:

a recording medium stacking unit on which recording media are stacked;

a binding unit having a binding section and a reference member, the binding section is movable to the inside of a stacking area of the recording media stacked on the recording medium stacking unit, binds the recording media by use of stapleless binding means which binds the recording media in a thickness direction, and retracts to the outside of the stacking area of the recording media after binding the recording media, the binding section and the reference member are configured to move in the same direction as the binding unit;

the reference member that is moved to the inside of the stacking area while maintaining separation from the recording media stacked on the recording medium stacking unit as the binding section is moved to the inside of the stacking area, and functions as a position reference used for aligning the recording media; and an alignment unit that aligns end portions of the recording media facing the reference member by moving the recording media to a position where the recording media come into contact with the reference member from a position where the recording media are separated from the reference member, before the binding section binds the recording media.

2. The recording medium post-processing apparatus according to claim 1, wherein the alignment unit performs an operation, which makes the recording media retract to the position where the recording media are separated from the reference member after moving the recording media to the position where the recording media come into contact with the reference member and moves the recording media again to the position where the recording media come into contact with the reference member, once or a plurality of times.

3. The recording medium post-processing apparatus according to claim 2, further comprising:

a support member that is opposed to the binding section, wherein the reference member is configured to be movable in a direction where the reference member approaches and separates from the support member for supporting the recording media when the binding section binds the recording media, is moved to a position where the reference member is separated from the support member while the binding section is moved to the inside of the stacking area of the recording media and while the binding section retracts to the outside of the stacking area, and is moved to a position where the reference member comes into contact with the support member after the binding section is moved to the inside of the stacking area and before the binding section binds the recording media.

4. The recording medium post-processing apparatus according to claim 3, wherein the support member is a flat surface.

5. The recording medium post-processing apparatus according to claim 2, further comprising:

a pressing member that presses the recording media between a support member and the pressing member before the binding section binds the recording media, wherein an end portion of the pressing member in a moving direction where the alignment unit moves the recording media is positioned downstream of the reference member in the moving direction.

6. The recording medium post-processing apparatus according to claim 1, wherein the binding section binds the recording media after pressing the recording media in a thickness direction between a moving surface of the binding unit and a support member.

7. An image forming system comprising:

an image forming apparatus that forms images on recording media; and a recording medium post-processing apparatus to which the recording media on which images are formed by the image forming apparatus are sequentially sent, and which binds the recording media, wherein the recording medium post-processing apparatus includes a recording medium stacking unit on which a plurality of recording media sent from the image forming apparatus are sequentially stacked, a binding unit having a binding section and a reference member, the binding section is movable to the inside of a stacking area of the recording media stacked on the recording medium stacking unit, binds the recording media by use of stapleless binding means which binds the recording media in a thickness direction, and retracts to the outside of the stacking area of the recording media after binding the recording media, the binding section and the reference ember are configured to move in the same direction as the binding unit, the reference member that is moved to the inside of the stacking area while maintaining separation from the recording media stacked on the recording medium stacking unit as the binding section is moved to the inside of the stacking area, and functions as a position reference used for aligning the recording media, and an alignment unit that aligns end portions of the recording media facing the reference member by moving the recording media to a position where the recording media come into contact with the reference member from a position where the recording media are separated from the reference member, before the binding section binds the recording media.

8. The image forming system according to claim 7, wherein the alignment unit of the recording medium post-processing apparatus performs an operation, which makes the recording media retract to the position where the recording media are separated from the reference member after moving the recording media to the position where the recording media come into contact with the reference member and moves the recording media again to the position where the recording media come contact with the reference member, once or a plurality of times.

9. The image forming system according to claim 8, further comprising:

a support member that is opposed to the binding section, wherein the reference member of the recording medium post-processing apparatus is configured to be movable in a direction where the reference member approaches and separates from the support member for supporting the recording media when the binding section binds the recording media, is moved to a position where the reference member is separated from the support member while the binding section is moved to the inside of the stacking area of the recording media and while the binding section retracts to the outside of the stacking area, and is moved to a position where the reference member comes into contact with the support member after the binding section is moved to the inside of the stacking area and before the binding section binds the recording media.

10. The image forming system according to claim 9, wherein the support member is a flat surface.

11. The image forming system according to claim 8, wherein the recording medium post-processing apparatus further includes a pressing member that presses the recording media between a support member and the pressing member before the binding section binds the recording media, and an end portion of the pressing member of the recording medium post-processing apparatus in a moving direction where the alignment unit moves the recording media is positioned downstream of the reference member in the moving direction.

* * * * *